US007800308B2

(12) United States Patent
Oda et al.

(10) Patent No.: US 7,800,308 B2
(45) Date of Patent: Sep. 21, 2010

(54) EXCIMER LAMP

(75) Inventors: Fumihiko Oda, Hyogo (JP); Kengo Moriyasu, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 200 days.

(21) Appl. No.: 12/230,490

(22) Filed: Aug. 29, 2008

(65) Prior Publication Data

US 2009/0058299 A1 Mar. 5, 2009

(30) Foreign Application Priority Data

Aug. 31, 2007 (JP) ..... 2007-226551

(51) Int. Cl.
*H01J 65/00* (2006.01)

(52) U.S. Cl. ..... 313/634; 313/607; 313/234

(58) Field of Classification Search ..... None
See application file for complete search history.

(56) References Cited

U.S. PATENT DOCUMENTS 4,201,692 A * 5/1980 Christophorou et al. ..... 252/372
5,006,758 A * 4/1991 Gellert et al. ..... 313/634
6,379,024 B1 * 4/2002 Kogure et al. ..... 362/263
7,468,145 B2 * 12/2008 Zukawa et al. ..... 252/301.4 R

FOREIGN PATENT DOCUMENTS

| | | | |
|---|---|---|---|
| JP | 63-098163 | A | 4/1988 |
| JP | 06-310106 | A | 11/1994 |
| JP | 11-329368 | A | 11/1999 |
| JP | 3178162 | B2 | 4/2001 |
| JP | 2007-173090 | A | 7/2007 |

* cited by examiner

*Primary Examiner*—Ashok Patel
(74) *Attorney, Agent, or Firm*—Rader, Fishman & Grauer PLLC

(57) ABSTRACT

A excimer lamp comprises an electric discharge container in which a sealing member is provided between a lid member and an arc tube which does not contain silica, and a pair of external electrodes which are separately provided on an outer surface of the arc tube, wherein rare gas and a fluoride is enclosed in the electric discharge container, and the fluoride is sulfur hexafluoride, carbon tetrafluoride, or nitrogen trifluoride.

3 Claims, 12 Drawing Sheets

| | Enclosed Gas | Applied Voltage (KVpp) | Optical Intensity | Creeping Discharge | Life Span (h) |
|---|---|---|---|---|---|
| Comparative Example 1 | Ar(99. 9%), $F_2$(0. 1%) | 3 | 1 | Not Occurred | 10 |
| First Embodiment | Ar(99. 9%), $SF_6$(0. 1%) | 3 | 0.5 | Not Occurred | >1000 |

FIG. 9

| | | Enclosed Gas | Applied Voltage (KVpp) | Optical Intensity | Creeping Discharge | Life Span (h) |
|---|---|---|---|---|---|---|
| Comparative Example 1 | | Ar(99.9%), $F_2$(0.1%) | 3 | 1 | Not Occurred | 10 |
| Comparative Example 2 | | Ar(99.9%), $SF_6$(0.1%) | 5 | 0.7 | Occurred | — |
| Second Embodiment | Lamp A | Ar(99.9%), $SF_6$(0.1%) | 7 | 1.1 | Not Occurred | >1000 |
| | Lamp B | Ar(99.9%), $CF_4$(0.1%) | | | | |
| | Lamp C | Ar(99.9%), $NF_3$(0.1%) | | | | |
| Third Embodiment | Lamp D | Ar(99.9%), $SF_6$(0.1%) | 8 | 1.2 | | |
| | Lamp E | Ar(99.9%), $CF_4$(0.1%) | | | | |
| | Lamp F | Ar(99.9%), $NF_3$(0.1%) | | | | |

FIG. 10

EXCIMER LAMP

CROSS-REFERENCES TO RELATED APPLICATION

The disclosure of Japanese Patent Application No. 2007-226551, filed Aug. 31, 2007 including its specification, claims and drawings, are incorporated herein by reference in its entirety.

TECHNICAL FIELD

Described herein is an excimer lamp, and in particular, an excimer lamp in which an electrode is provided in an outer surface of an arc tube.

BACKGROUND

Conventionally, an excimer lamp is used as a light source of ultraviolet rays for photochemical reaction. For example, such an excimer lamp is disclosed in Japanese Patent No. 3178162.

FIGS. 11, 12A and 12B are diagrams for explaining the conventional excimer lamp 1 disclosed in Japanese Patent No. 3178162. FIG. 11 is a perspective view of the excimer lamp 1. FIG. 12A is a cross sectional view of an arc tube 21 of the excimer lamp 1 shown in FIG. 11, taken along a direction of a tube axis thereof. FIG. 12B is a cross sectional view thereof, taken along a direction perpendicular to the tube axis of the arc tube 21 shown in FIG. 12A (a cross sectional view thereof taken along a line F-F of FIG. 12A). In FIGS. 12A and 12B, the same reference numerals as those of FIG. 11 are assigned to the same structural parts as those shown in FIG. 11.

Lid portion members 221 and 222 are arranged so as to cover both ends of the straight tube shaped arc tube 21 of the excimer lamp 1, which are free ends. Sealing members 231 and 232 are filled up between the arc tube 21 and the respective lid portion members 221 and 222, so that the arc tube 21 and the respective lid portion members 221 and 222 are connected to each other. Thereby, an electric discharge container 2 which is made up of the arc tube 21, the lid portion members 221 and 222, and the sealing members 231 and 232 is formed.

A gas pipe 2221 is provided in the second lid portion member 222. After air in an inner space 24 of the electric discharge container 2 is discharged from the gas pipe 2221, krypton (Kr) and fluorine ($F_2$) gas is enclosed as light emitting gas. A sealing portion 2222 is formed by welding the gas pipe 2221 with pressure after the enclosure of the light emitting gas.

A pair of external electrodes 31 and 32 which are electrically separated from each other is provided on the outer surface of the arc tube 21. Leads 41 and 42 are electrically connected to the respective end portions of the external electrodes 31 and 32 in the longitudinal direction thereof by, for example, solders 51 and 52.

The leads 41 and 42 are connected to a power supply (not shown). Electric discharge occurs in the arc tube 21, between the pair of external electrodes 31 and 32 to which electric power is supplied from the leads 41 and 42, when a lamp 1 is lit. The light emitting gas enclosed in the inner space 24 of the electric discharge container 2 is ionized, so that, for example, krypton ions and fluorine ions are formed in the inner space 24 of the electric discharge container 2, whereby excimer molecules which consist of krypton-fluorine are formed, and, for example, light with a wavelength of approximately 248 nm is generated.

SUMMARY

When the lamp 1 is lit, the ionized fluorine ions are diffused throughout the inner space 24 of the electric discharge container 2, so that the inner space is filled up with fluorine ions. Even if, for example, fluorine resin which is hard to absorb fluorine is formed on the sealing members 231 and 232, the fluorine is absorbed as lighting time of the lamp 1 passes. Since the ionized fluorine ions contribute to emission of light, when the ionized fluorine ions decrease with passage of lighting time of the lamp 1, the illuminance thereof decreases. That is, in the conventional excimer lamp 1, there is a problem of a life span, in that an illuminance cannot be maintained for a long time.

Hereinafter, an excimer lamp capable of controlling absorption of fluorine ions into sealing members when a lamp is lit will be offered below.

The present excimer lamp comprises an electric discharge container in which a sealing member is provided between a lid member and an arc tube which does not contain silica, and a pair of external electrodes which are separately provided on an outer surface of the arc tube, wherein rare gas and a fluoride is enclosed in the electric discharge container, and the fluoride is sulfur hexafluoride, carbon tetrafluoride, or nitrogen trifluoride.

The excimer lamp may further include an insulator or grooves which are formed between the external electrodes which face each other on an outer surface of the arc tube.

In the excimer lamp, the external electrodes may be covered with an insulator.

In the excimer lamp according to a first embodiment, since the chemical stability of the fluoride enclosed in the electric discharge container is high, even at time the lamp is lit, the ionized fluorine ions can return to fluoride, in a range from the end portions in which the external electrodes face each other in the electric discharge container, to the respective sealing members which are located near there. Since contacts of the sealing members with fluorine ions can be suppressed, it is possible to suppress absorption of the fluorine ions into the sealing members. That is, in the excimer lamp according to the first embodiment, the illuminance deterioration due to absorption of the fluorine ions in sealing members can be suppressed, so that the illuminance thereof can be maintained for a long time.

In the excimer lamp according to a second embodiment, creeping discharge between the electrodes provided on the outer surface of the electric discharge container can be suppressed.

Since, in the excimer lamp according to a third embodiment, the outer surface of the external electrodes can be electrically insulated, the creeping discharge between the electrodes on the outer surface of the arc tube can be prevented. Furthermore, it is possible to electrically insulate the external electrodes from the outside.

BRIEF DESCRIPTION OF THE DRAWINGS

Other features and advantages of the present excimer lamp will be apparent from the ensuing description, taken in conjunction with the accompanying drawings, in which:

FIG. 9 is a table of an experimental result of excimer lamps;

FIG. 10 is a table showing an experimental result of excimer lamps;

DESCRIPTION

Figure 1:
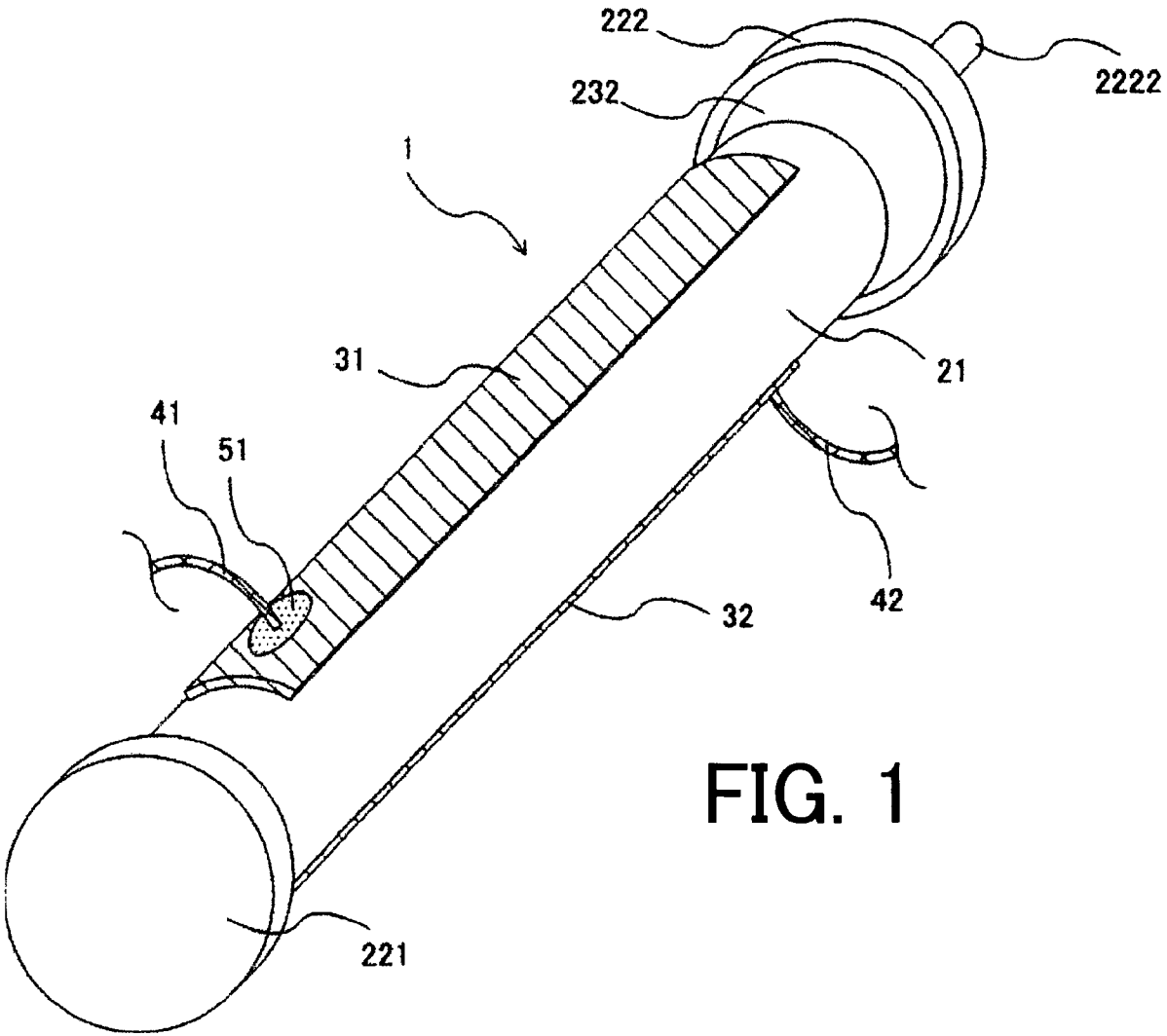
FIG. 1 is a diagram of an excimer lamp according to a first embodiment.

The descriptions in the specification are provided for illustrative purposes only, and are not limiting thereto. An appreciation of various aspects of the present excimer lamp is best gained through a discussion of various examples thereof. The meaning of these terms will be apparent to persons skilled in the relevant arts based on the entirety of the teachings provided herein.

The present excimer lamp 1 comprises an electric discharge container 2 having an arc tube 21 which does not contain silica (Si), and which is sealed with sealing members 231 and 232, and at least a pair of external electrodes 31 and 32 provided on the outer surface of the arc tube 21, wherein light emitting gas is enclosed in the electric discharge container 2. The light emitting gas is, for example, rare gas and a fluoride with high chemical stability. The light emitting gas forms rare-gas ions and fluorine ions at time the lamp 1 is lit.

Description of a first embodiment of the excimer lamp 1 will be given below, referring to FIGS. 1 and 2A and 2B.

Figure 2A:
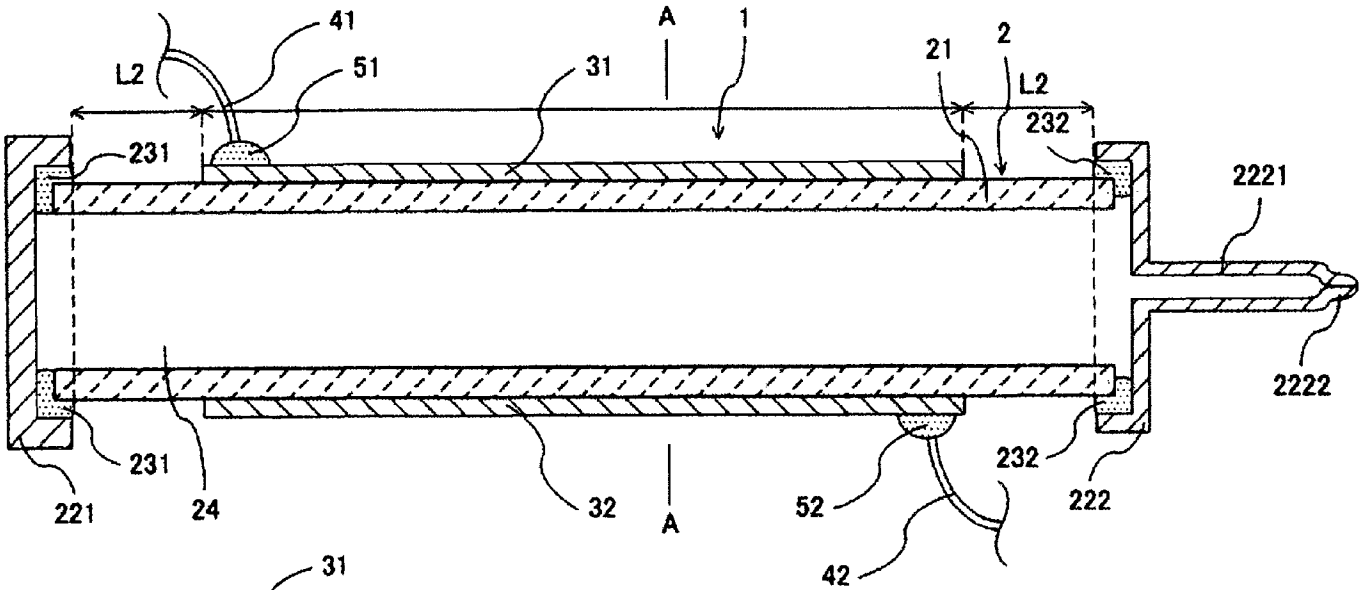
FIGS. 2A and 2B are diagrams of an excimer lamp according to a first embodiment.
Figure 2B:
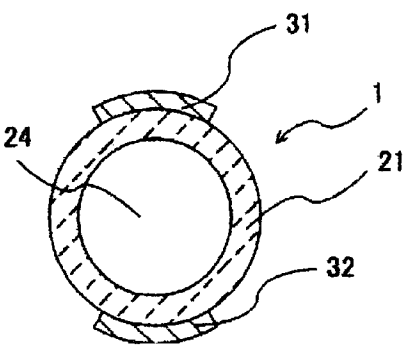

FIGS. 1, 2A and 2B are explanatory diagrams of the excimer lamp 1 according to the embodiment. FIG. 1 is a perspective view of the excimer lamp 1. FIG. 2A is a cross sectional view of the excimer lamp 1, taken along a direction of the tube axis of the arc tube 21. FIG. 2B is a cross sectional view thereof, taken along a direction perpendicular to the tube axis direction of the arc tube 21 of FIG. 2A (a cross sectional view thereof, taken along a line A-A of FIG. 2A). In FIGS. 1, 2A and 2B, the same reference numerals as those of FIGS. 12A and 12 B are assigned to the same structural parts as those shown in FIGS. 12A and 12B.

The arc tube 21 of the excimer lamp 1 according to the embodiment is in the shape of a straight pipe. The arc tube 21 has optical permeability to wavelengths of 150-400 nm, and is formed of material with little absorption of fluorine ions. As the material of the arc tube 21, for example, metal oxides such as sapphire (single crystal alumina) or alumina (polycrystal alumina), whose principal component is aluminum oxide ($Al_2O_3$), may be used. In addition, a fluoride such as magnesium difluoride ($MgF_2$), lithium fluoride (LiF), calcium difluoride ($CaF_2$), barium difluoride ($BaF_2$), or YAG (yttrium aluminum garnet) may be used as the material of the arc tube 21. Although quartz glass ($SiO_2$) may be selected as the material which has the optical permeability, since silica (Si) contained in the quartz glass ($SiO_2$) has the high reactivity with fluorine ions, the quartz glass ($SiO_2$) might not be used as the material of the arc tube 21 which comes into contact with fluorine ions while the lamp 1 is lit. For this reason, material which does not contain silica (Si) is used suitably, for the arc tube 21 which consists of material with little absorption of fluorine ions.

The arc tube 21 in the longitudinal direction has openings at both ends thereof respectively, and cup-like lid portion members 221 and 222 are arranged on the both ends. The lid portion members 221 and 222 are made of the so-called kovar which is an alloy in which nickel (Ni) and cobalt (Co) are blended with iron (Fe). The material of the lid portion members 221 and 222 is not limited to such a metal. Since material having ultraviolet light resistance can be used for the lid portion members 221 and 222, for example, sapphire (single crystal alumina) whose principal component is aluminum oxide ($Al_2O_3$) which is the same material as that of the arc tube 21 may be used therefor.

The sealing members 231 and 232 are filled up between the arc tube 21 and the lid portion members 221 and 222, respectively, whereby the arc tube 21 and the lid portion members 221 and 222 are connected to each other, so that the electric discharge container 2 which is made up of the arc tube 21, the lid portion members 221 and 222, and the sealing members 231 and 232 is formed. Also, wax material which consists of, for example, an alloy (Ag—Cu alloy) of silver and copper can be used as the material of the sealing members 231 and 232 in order to seal the spaces between the arc tube 21 and the lid portion members 231 and 232. Since, at the time the lamp 1 is lit, not only ultraviolet rays are irradiated to the sealing members 231 and 232, but the sealing members 231 and 232 are also heated by lighting of the lamp 1, material having ultraviolet light resistance and thermal resistance can be used. Especially, material such as an alloy (Ag—Cu alloy) of silver and copper, which absorbs little fluorine ions can be suitably used.

The gas pipe 2221 is provided to the second lid portion member 222. After air in the inner space 24 of the electric discharge container 2 is exhausted from the gas pipe 2221 so that the pressure thereof is reduced, rare gas and a fluoride having high chemical stability is filled in as the light emitting gas. After filling the light emitting gas therein, an electric discharge container 2 is formed as a sealed structure by forming a sealing portion 2222 to the gas pipe 2221 by a pressure welding etc. Rare gas which is argon (Ar), krypton (Kr), or xenon (Xe), and a fluoride which is sulfur hexafluoride ($SF_6$), carbon tetrafluoride ($CF_4$), or nitrogen trifluoride ($NF_3$) may be used as a light emitting gas filled in the inner space 24 of the electric discharge container 2.

As shown in FIG. 2B, a pair of external electrodes 31 and 32 is arranged on the outer surface of the arc tube 21, so as to be electrically separated from each other. As shown in FIG. 2A, the pair of the electrodes is provided, so as to extend along the tube axis direction of the arc tube 21. Furthermore, the external electrodes 31 and 32 are provided so as to be separately placed from the sealing members 231 and 232 and the lid portion members 221 and 222. The external electrodes 31 and 32 can be formed by applying, for example, copper in paste form, to the outer surface of the arc tube 21. Moreover, for example, plate-like aluminum can also be pasted on the outer surface of the arc tube 21 with an adhesive agent etc. Each of the leads 41 and 42 is electrically connected to one end of the external electrode with solder 51 or 52 etc. in a longitudinal direction of the external electrode 31 or 32. A power supply (not shown) is connected to the leads 41 and 42, and electric power is supplied at time the lamp 1 is lit.

Electric discharge occurs between the pair of external electrodes 31 and 32 through the arc tube 21 by impressing voltage between the external electrodes 31 and 32 when the lamp 1 is lit. When the rare gas used as the light emitting gas is argon (Ar), and the fluoride is, for example, sulfur hexafluoride ($SF_6$), they are ionized so that argon ions and fluorine ions are formed, whereby excimer molecules which consist of argon-fluorine are formed, and light with wavelengths of approximately 193 nm is emitted from the arc tube 21.

As shown in FIG. 2B, electric discharge occurs between the external electrode 31 and 32 at time the lamp 1 is lit, in a range L1 in the tube axis direction of the arc tube 21 in which the external electrodes 31 and 32 face each other. When the arc tube 21 is made of material which does not contain silica (Si), as material with little absorption of fluorine ions, it is possible to prevent the arc tube 21 from absorbing the ionized fluorine ions.

Since, in the inner space 24 of the electric discharge container 2, the external electrodes 31 and 32 are provided in a position where they are separated from the sealing members 231 and 232 and the lid portion members 221 and 222 in the tube axis direction of the arc tube 21, no electric discharge occur in a range L2 extending from the end portions of the range L1 where the external electrodes 31 and 32 in the tube axis direction of the arc tube 21 face each other, to the respective sealing members 231 and 232 which are located near there. For this reason, when material such as sulfur hexafluoride ($SF_6$), with high chemical stability, is filled, as the light emitting gas, in the inner space 24 of the electric discharge container 2, since no electric discharge occurs in the range L2 from the end portions of the range L1 where the external electrodes 31 and 32 in the direction of the tube axis of the arc tube 21 face each other, to the respective sealing members 231 and 232 which are located near there, the fluorine ions ionized by electric discharge returns to, for example, sulfur hexafluoride which was before the ionization. Thereby, in the inner space 24 of the electric discharge container 2, as compared with the range L1 where the external electrodes 31 and 32 in the tube axis direction of the arc tube 21 face each other, the fluorine ions decrease extremely in the range L2 from the end portions of the range L1 where the external electrodes 31 and 32 in the tube axis direction of the arc tube 21 face each other, to the respective sealing members 231 and 232 which are located near there. That is, since it is possible to suppress contacts of fluorine ions with the sealing members 231 and 232, it is possible to prevent decrease of the fluorine ions in the inner space 24 of the electric discharge container 2 when the lamp 1 is lit, and the illuminance reduction of the lamp 1 due to the fluorine ion reduction can be prevented.

The excimer lamp 1 according to this embodiment comprises the electric discharge container 2 having the sealing members 231 and 232 in the arc tube 21 which does not contain silica, and at least a pair of external electrodes 31 and 32 provided on the outer surface of the arc tube 21, wherein rare gas and a fluoride are enclosed in the electric discharge container 2, and further the fluoride consisting of sulfur hexafluoride, carbon tetrafluoride, or nitrogen trifluoride. Since the chemical stability of the fluoride enclosed in the electric discharge container 2 is high, even when the lamp 1 is lit, in the range L2 from the end portions of the range L1 where the external electrodes 31 and 32 face each other in the inner space 24 of the electric discharge container 2, to the respective sealing members which are located near there, the ionized fluorine ions can return to a fluoride. Since it is possible to suppress contacts of the sealing members 231 and 232 with fluorine ions, absorption of the fluorine ions by the sealing members 231 and 232 can be suppressed. That is, the excimer lamp 1 according to this embodiment can control illuminance reduction due to absorption of the fluorine ions in the sealing members 231 and 232, so that an illuminance can be maintained for a long time.

Description of a second embodiment of an excimer lamp 1 will be given below, referring to FIGS. 3, 4A and 4B.

Figure 3:
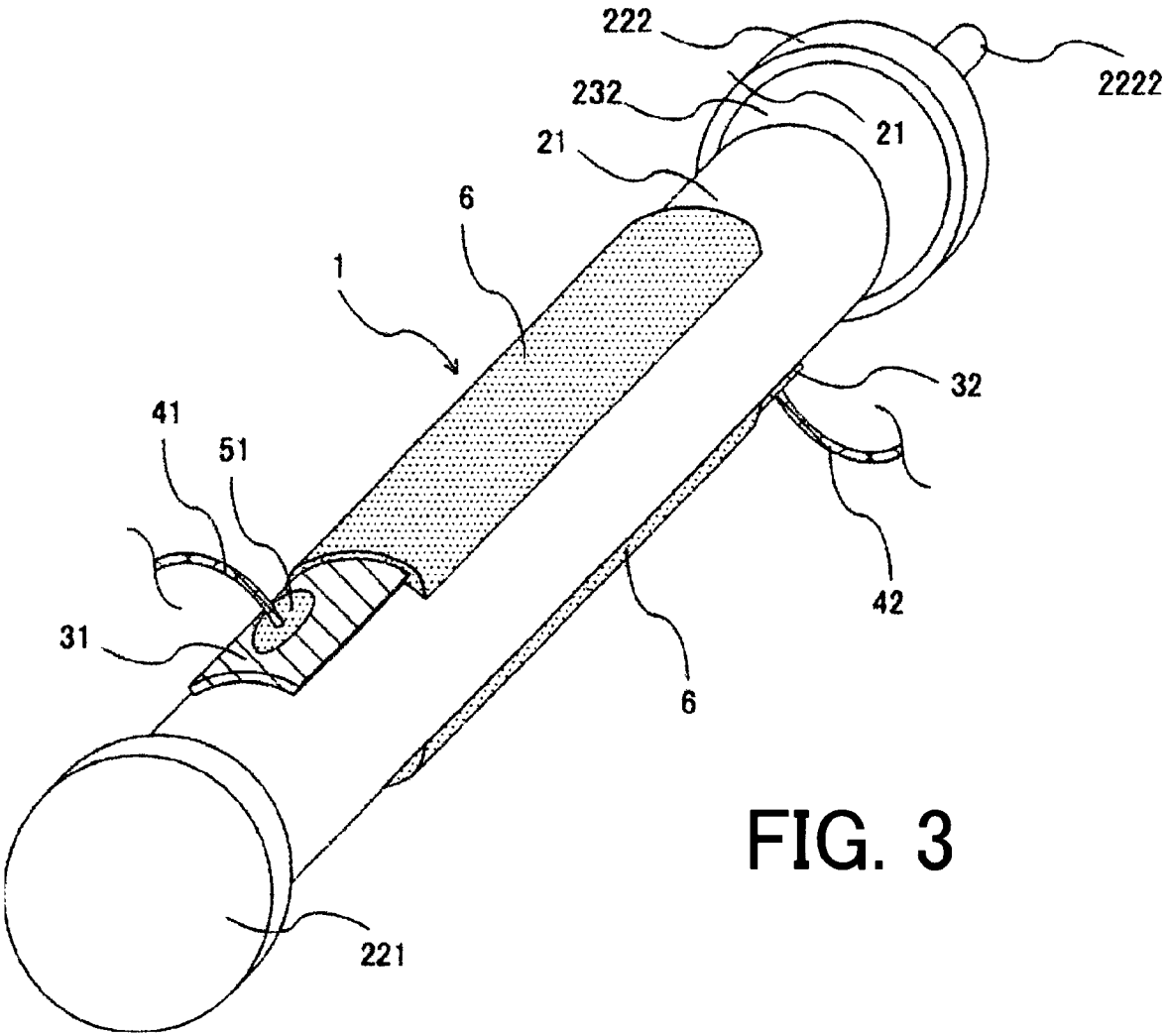
FIG. 3 is a diagram of an excimer lamp according to a second embodiment.
Figure 4A:
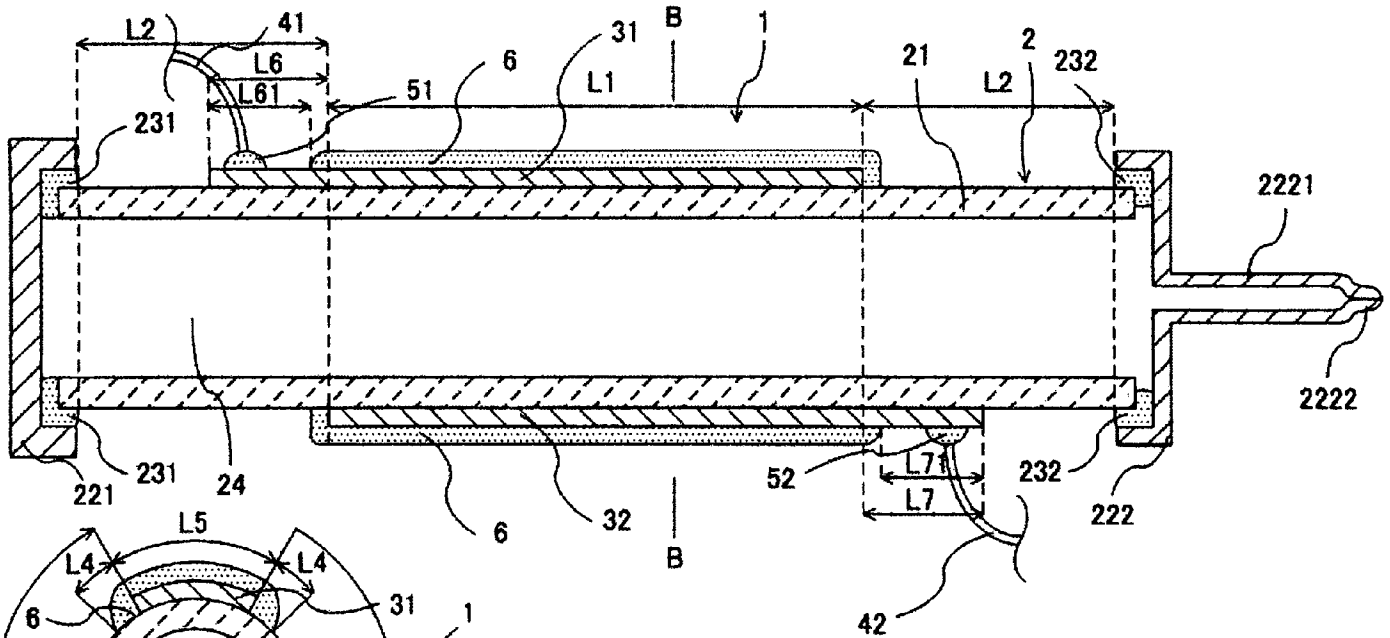
FIGS. 4A and 4B are diagrams of an excimer lamp according to a second embodiment.
Figure 4B:
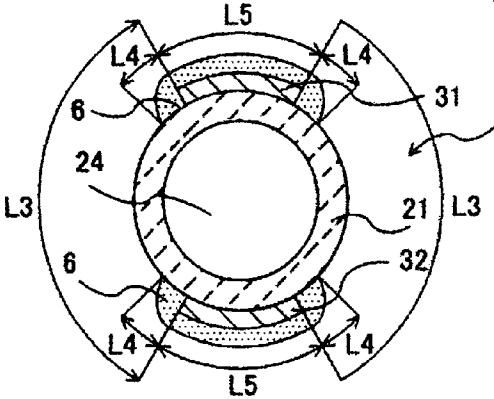

FIGS. 3, 4A and 4B are diagrams for explaining the excimer lamp 1 according to the embodiment. FIG. 3 is a perspective view of the excimer lamp 1. FIG. 4A is a cross sectional view of the excimer lamp 1, taken along a direction of the tube axis of an arc tube 21 of the excimer lamp 1. FIG. 4B is a cross sectional view thereof, taken along a direction perpendicular to the tube axis direction of the arc tube 21 of FIG. 4A (a cross sectional view thereof taken along a line B-B of FIG. 4A). In FIGS. 3, 4A and 4B, the same reference numerals as those of FIG. 2 are assigned to the same structural parts as those shown in FIG. 2.

The excimer lamp 1 shown in FIGS. 3, 4A and 4B is different from that shown in FIGS. 1, 2A and 2B, in that external electrodes 31 and 32 are covered with an insulator 6. Description of FIGS. 3 and 4 will be given below in view of the difference between the excimer lamp shown in FIGS. 3, 4A and 4B and that shown in FIGS. 1, 2A and 2B.

The arc tube 21 of the excimer lamp 1 according to the embodiment, is in the shape of a straight pipe. The arc tube 21 has optical permeability to wavelengths of 150-400 nm, and is formed of material with little absorption of fluorine ions. As the material of the arc tube 21, for example, metal oxides such as sapphire (single crystal alumina) or alumina (polycrystal alumina), whose principal component is aluminum oxide ($Al_2O_3$), may be used. In addition, a fluoride such as magnesium difluoride ($MgF_2$), lithium fluoride (LiF), calcium difluoride ($CaF_2$), barium difluoride ($BaF_2$), or YAG (yttrium aluminum garnet) may be used as the material of the arc tube 21. Although quartz glass ($SiO_2$) may be selected as the material which has the optical permeability, since silica (Si) contained in the quartz glass ($SiO_2$) has the high reactivity with fluorine ions, the quartz glass ($SiO_2$) might not be used as the material of the arc tube 21 which comes into contact with fluorine ions while the lamp 1 is lit. For this reason, material which does not contain silica (Si) is used suitably, for the arc tube 21 which consists of material with little absorption of fluorine ions.

The arc tube 21 in the longitudinal direction has openings at both ends thereof, respectively, and cup-like lid portion members 221 and 222 are arranged on the both ends. The lid portion members 221 and 222 are made of the so-called kovar which is an alloy in which nickel (Ni) and cobalt (Co) are blended with iron (Fe). The material of the lid portion members 221 and 222 is not limited to such a metal. Since material having ultraviolet light resistance can be used for the lid portion members 221 and 222, for example, sapphire (single crystal alumina) whose principal component is aluminum oxide ($Al_2O_3$) which is the same material as that of the arc tube 21 may be used therefor.

Sealing members 231 and 232 are filled up between the arc tube 21 and the respective lid portion members 221 and 222, whereby the arc tube 21 and the lid portion members 221 and 222 are connected to each other, so that an electric discharge container 2 which is made up of the arc tube 21, the lid portion members 221 and 222, and the sealing members 231 and 232 is formed. Also, wax material which is, for example, an alloy (Ag—Cu alloy) of silver and copper can be used as the material of the sealing members 231 and 232 in order to seal the spaces between the arc tube 21 and the respective lid portion members 231 and 232. Since, at the time the lamp 1 is lit, not only ultraviolet rays are irradiated to the sealing members 231 and 232, but the sealing members 231 and 232 are also heated by lighting of the lamp 1, material having ultraviolet light resistance and thermal resistance can be used. Especially, material such as an alloy (Ag—Cu alloy) of silver and copper, which absorbs little fluorine ions can be suitably used.

A gas pipe 2221 is provided to the second lid portion member 222. After air in the inner space 24 of the electric discharge container 2 is discharged from the gas pipe 2221 so that the pressure thereof is reduced, rare gas and a fluoride having high chemical stability is filled therein as light emitting gas. After filling the light emitting gas therein, an electric discharge container 2 is formed as a sealed structure by forming a sealing portion 2222 to the gas pipe 2221 by a pressure welding etc. The rare gas which is, for example, argon (Ar), krypton (Kr), or xenon (Xe), and a fluoride which is, for example, sulfur hexafluoride ($SF_6$), carbon tetrafluoride ($CF_4$), or nitrogen trifluoride ($NF_3$) may be used as a light emitting gas filled in the inner space 24 of the electric discharge container 2.

As shown in FIG. 4B, a pair of external electrodes 31 and 32 is arranged on the outer surface of the arc tube 21, so as to be electrically separated from each other. As shown in FIG. 2A, the pair of the electrodes is provided, so as to extend along the tube axis direction of the arc tube 21. Furthermore, the external electrodes 31 and 32 are provided so as to be separately placed from the sealing members 231 and 232 and the lid portion members 221 and 222. The pair of external electrodes 31 and 32 is provided so as to have portions L6 and L7 where the electrodes 31 and 32 do not respectively face the other electrode at end portions in a longitudinal direction thereof. As shown in FIG. 4A, the first external electrode 31 has the portion L6 which does not face the second external electrode 32, in the first lid portion member 221 side in the longitudinal direction. Moreover, the second external electrode 32 has the portion L7 which does not face the first external electrode 31, in the second lid portion member 222 side in the longitudinal direction.

The external electrodes 31 and 32 can be formed by applying, for example, copper in paste form, to the outer surface of the arc tube 21. Moreover, for example, plate-like aluminum can also be pasted on the outer surface of the arc tube 21 with an adhesive agent etc.

An insulator 6 is formed so as to cover the outer face of the external electrodes 31 and 32 provided on the outer surface of the arc tube 21. As shown in FIG. 4A, the insulator 6 is formed in the tube axis direction of the arc tube 21, so as to extend over the range L1 in the tube axis direction of the arc tube 21 where the external electrodes 31 and 32 face each other. Moreover, as shown in FIG. 4B, the insulator 6 is formed in the circumferential direction of an arc tube 21, so as to cover portions L4 which are located (in portions L3) between the external electrodes 31 and 32 which face each other on the outer circumferential surface of the arc tube 21 but which are located outside the external electrodes 31 and 32 in a circumferential direction of the outer circumferential surface of the arc tube 21, and portions L5 which are located outside the external electrodes 31 and 32 in the diameter direction of the arc tube 21. The insulator 6 is formed by applying, for example, paste in which silica particles are dispersed in organic solvent, so as to cover the outside portions of the external electrodes 31 and 32, and sintering the applied paste. Moreover, material having a dielectric constant lower than that of material of the external electrodes 31 and 32 is used as material of the insulator 6. In particular, when the dielectric constant of the material of the insulator 6 is lower than that of the material of the arc tube 21, the material of the insulator 6 may suitably function as an insulator between the electrodes 31 and 32 when the lamp 1 is lit.

A first lead 41 is electrically connected, by a first solder 51 etc., to a portion L61 of the first external electrode 31 which does not face the second external electrode 32 and which is not covered with the insulator 6 so as to be exposed to the outside of the first external electrode 31. A first lead 42 is electrically connected, by a first solder 52 etc., to a portion L71 of the second external electrode 32 which does not face the first external electrode 31 and which is not covered with the insulator 6 so as to be exposed to the outside of the first external electrode 32. A power supply (not shown) is connected to the leads 41 and 42, and electric power is supplied when the lamp 1 is lit.

An electric discharge occurs between the pair of external electrode 31 and 32 through the arc tube 21 by impressing voltage between the external electrodes 31, and 32 at time the lamp 1 is lit. When, for example, the rare gas used as the light emitting gas is argon (Ar), and the fluoride is sulfur hexafluoride ($SF_6$), they are ionized so that argon ions and fluorine ions are formed, whereby excimer molecules which consist of argon-fluorine are formed, and light with wavelengths of approximately 193 nm is emitted from the arc tube 21.

As shown in FIG. 4B, electric discharge which occurs between the external electrodes 31 and 32 at time of lighting of the lamp 1 occurs through the arc tube 21 in a range L1 in the tube axis direction of the arc tube 21, where the external electrode 31 and the 32 face each other. When the arc tube 21 is made of material which does not contain silica (Si) as material with little absorption of fluorine ions, it possible to prevent the arc tube 21 from absorbing the ionized fluorine ions.

Since, in the inner space 24 of the electric discharge container 2, the external electrodes 31 and 32 are provided in positions where they are separately placed from the sealing members 231 and 232 and the lid portion members 221 and 222 in the tube axis direction of the arc tube 21, no electric discharge occurs in a range L2 extending from the end portions of the range L1 where the external electrodes 31 and 32 in the tube axis direction of the arc tube 21 face each other, to the respective sealing members 231 and 232 which are located near there. For this reason, when material such as sulfur hexafluoride ($SF_6$), with high chemical stability, is filled as the light emitting gas, since in the inner space 24 of the electric discharge container 2, no electric discharge occurs in the range L2 from the end portions of the range L1 where the external electrodes 31 and 32 in the direction of the tube axis of the arc tube 21 face each other, to the respective sealing members 231 and 232 which are located near there, the fluorine ions ionized by the electric discharge return to, for example, sulfur hexafluoride which was before the ionization. Thereby, in the inner space 24 of the electric discharge container 2, as compared with the range L1 where the external electrodes 31 and 32 in the tube axis direction of the arc tube 21 face each other, the fluorine ions decrease extremely in the range L2 from the end portions of the range L1 where the external electrodes 31 and 32 in the tube axis direction of the arc tube 21 face each other, to the respective sealing members 231 and 232 which are located near there. That is, since it is possible to suppress contacts of fluorine ions with the sealing members 231 and 232, it is possible to prevent decrease of the fluorine ions in the inner space 24 of the electric discharge container 2 when the lamp 1 is lit, whereby the illuminance reduction of the lamp 1 due to the fluorine ion reduction can be prevented.

In order to use the excimer lamp 1 according to the embodiment as an ultraviolet rays light source for photochemical reaction, it is necessary to stably start electric discharge. Furthermore, generation of electrons which have high energy required to generate excimer molecules in the excimer lamp 1 is required. However, the chemical stability of the fluoride contained in the inner space 24 of the electric discharge container 2 is high. That is, a fluoride with the high chemical stability, which is sulfur hexafluoride ($SF_6$), carbon tetrafluoride ($CF_4$), or nitrogen trifluoride ($NF_3$) is gas having high electron attachment nature (in other words, it exhibits the property of capturing electrons, largely). For this reason, since electrons produced by ionization are captured with high probability, breakdown voltage thereof becomes higher than that of the conventional lamp 1 in which fluorine ($F_2$) gas is enclosed. Furthermore, in order to generate electrons with high energy, applied voltage needs to be high. Moreover, in the case of the excimer lamp 1 according to the embodiment, in order to obtain sufficient illuminance, 100 Torr or more of light emitting gas needs to be enclosed in the electric discharge container 2. As in the excimer lamp 1 according to the first embodiment shown in FIGS. 1, 2A and 2B, in case where it has the structure in which the external electrodes 31 and 32 are provided on the outer surface of the arc tube 21, when high voltage is impressed to the external electrodes 31 and 32, the so-called creeping discharge in which discharge occurs along a surface of the arc tube 21 between the external electrodes 31 and 32, is generated.

Then, as in the excimer lamp 1 according to this embodiment, creeping discharge can be suppressed by forming the insulator 6, in the circumferential direction of the arc tube 21 and along the external electrodes 31 and 32, at least in the portion L3 between the external electrodes 31 and 32 which face each other on the outer circumferential surface of the arc tube 21, but in portions L4 of outsides of the external electrodes 31 and 32 in the circumferential direction of the outer circumferential surface of the arc tube 21.

Furthermore, in case electric conductive material (for example, a work piece to which ultraviolet rays is irradiated) which is not shown, is arranged, for example, near the excimer lamp 1, if high voltage is inputted at a high frequency to the external electrodes 31 and 32, electric discharge occurs toward the electric conductive material (not shown) from the external electrode 31 (or/and, 32), so that the electric discharge between the external electrodes 31 and 32 may be disturbed. For this reason, since the insulator 6 is formed on the portions L5 which are located outside the external electrodes 31 and 32 in the diameter direction of the arc tube 21, it is possible to electrically insulate the portions L4 and L5 from the outside of the external electrodes 31 and 32.

The excimer lamp 1 according to this embodiment, comprises the electric discharge container 2 in which the sealing members 231 and 232 are provided in the arc tube 21 which does not contain silica, and at least the pair of the external electrodes 31 and 32 which are separately provided on the outer surface of the arc tube 21, wherein rare gas and a fluoride are enclosed in the electric discharge container 2, and the fluoride is sulfur hexafluoride, carbon tetrafluoride, or nitrogen trifluoride. Since the chemical stability of the fluoride enclosed in the electric discharge container 2 is high, the ionized fluorine ion can return to a fluoride even when the lamp 1 is lit, in the range L2 from the end portions of the range L1 where the external electrodes 31 and 32 face each other in the inner space 24 of the electric discharge container 2, to the respective sealing members which are located near there. Since it is possible to suppress contacts of the sealing members 231 and 232 and the fluorine ions, absorption of the fluorine ions in the sealing members 231 and 232 can be controlled. That is, according to the feature, in the excimer lamp 1 according to this embodiment, the illuminance fall due to the absorption of the fluorine ions in the sealing members 231 and 232 can be suppressed, and an illuminance thereof can be maintained for a long time.

Furthermore, the external electrodes 31 and 32 are covered with the insulator, so that the insulator 6 is formed on the portion L3 between the external electrodes 31 and 32 which face each other on the outer surface of the arc tube 21. For this reason, the creeping discharge in the portion L3 between the electrodes 31 and 32 on the outer surface of the electric discharge container 2 can be suppressed.

Moreover since the external electrodes 31 and 32 are covered with the insulator 6, the insulator 6 is formed in the outer portions L5 which are located outside the external electrodes 31 and 32 in the diameter direction of the arc tube 21. For this reason, in the excimer lamp 1 according to this embodiment, the outer portions L4 and L5 which are located outside the external electrodes 31 and 32 can be insulated to the outside thereof.

Figure 5A:
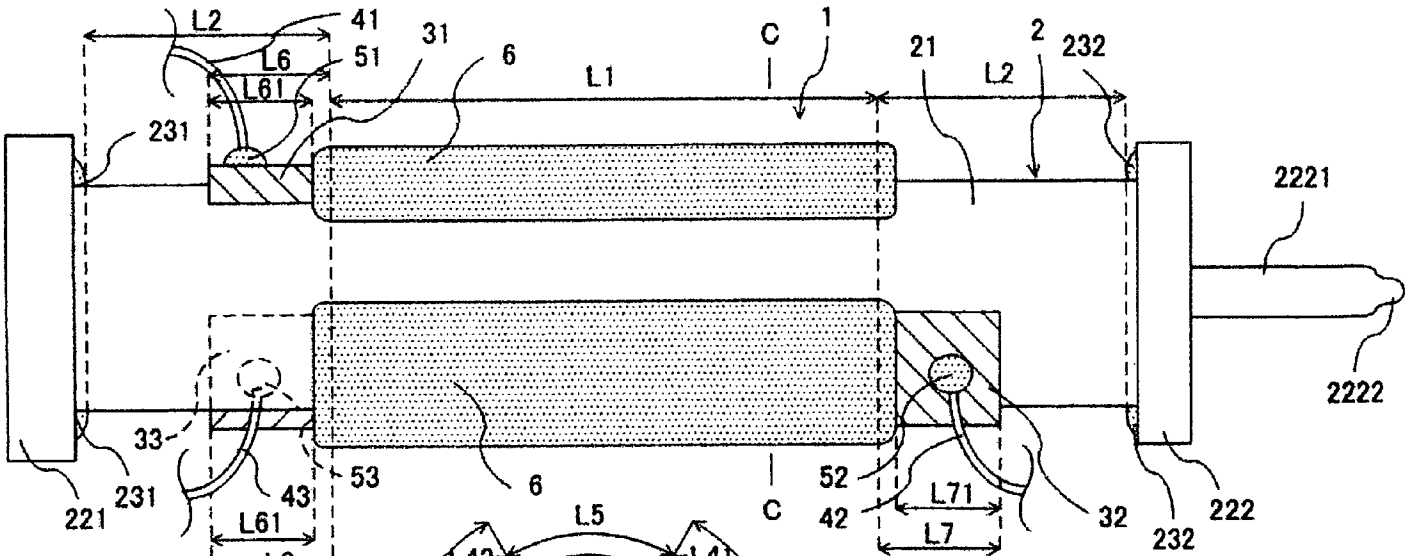
FIGS. 5A and 5B are diagrams of another form of the second embodiment of an excimer lamp.
Figure 5B:
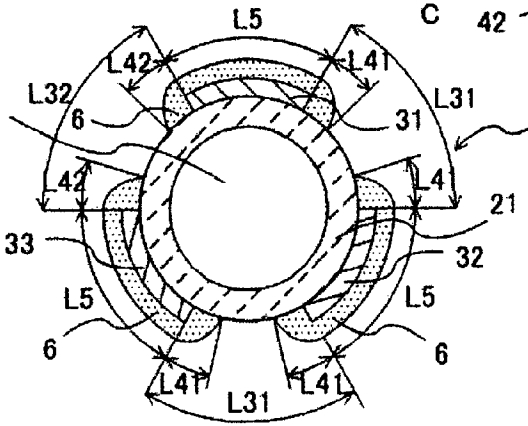

Another form of the second embodiment of the excimer lamp 1 will be described below referring to FIGS. 5A and 5B. FIGS. 5A and 5B are diagrams of the excimer lamp 1 according to the embodiment. FIG. 5A is a side elevational view thereof which is seen from a direction perpendicular to the tube axis of the arc tube 21 of the excimer lamp 1 (a side elevational view seen from the second external electrode 32 side). FIG. 5B is a cross sectional view thereof taken along a direction perpendicular to the tube axis of the arc tube 21 of FIG. 5A (a cross sectional view thereof taken along a line C-C of FIG. 5A). In FIGS. 5A and 5B, the same numerals as those of FIGS. 4A and 4B are assigned to the same structural elements as those of FIGS. 4A and 4B.

The excimer lamp 1 shown in FIGS. 5A and 5B is different from that shown in FIGS. 3, 4A and 4B, in that the excimer lamp 1 shown in FIGS. 5A and 5B has three external electrodes. FIGS. 5A and 5B will be described in terms of differences between the excimer lamp of FIGS. 3, 4A and 4B and that of FIGS. 5A and 5B.

The arc tube 21 of the excimer lamp 1 according to this embodiment is in a shape of a straight pipe, which is made of material having optical permeability with respect to 150-400 nm, and having little absorption of fluorine ions. The material of the arc tube 21, is, for example, a metal oxide such as sapphire (single crystal alumina), or alumina (polycrystal alumina), whose principal component is an aluminum oxide ($A_2O_3$). In addition, a fluoride such as magnesium difluoride ($MgF_2$), lithium fluoride (LiF), calcium difluoride ($CaF_2$), barium difluoride ($BaF_2$), or YAG (yttrium aluminum garnet) can be used as the material of the arc tube 21. In addition, although quartz glass ($SiO_2$) may be selected as the material having the optical permeability, since silica (Si) contained in quartz glass ($SiO_2$) has high reactivity with fluorine ions, the quartz glass ($SiO_2$) might not be used as the material of the arc tube 21 which is brought into contact with fluorine ions when the lamp 1 is lit. For this reason, material which does not contain silica (Si) is suitably used for the arc tube 21 which is made of material with little absorption of fluorine ions.

The arc tube 21 is opened at both ends in the longitudinal direction thereof, and cup-like lid portion members 221 and 222 are arranged at the both ends. The lid portion members 221 and 222 are formed of the so-called kovar, an alloy in which nickel (Ni) and cobalt (Co) is blended with iron (Fe). The material of the lid portion members 221 and 222 is not limited to such a metal. Since all that is required is that the material has ultraviolet light resistance, the lid portion member 221 and 222 may be made of material which is the same as that of the arc tube 21, that is, for example, sapphire (single crystal alumina) whose main component is aluminum oxide ($A_2O_3$) etc.

Since sealing members 231 and 232 are filled up between the arc tube 21 and the respective lid portion members 221 and 222, the arc tube 21 and the lid portion members 221 and 222 are respectively connected to each other, so that the electric discharge container 2 which is made up of the arc tube 21, the lid portion members 221 and 222, and the sealing members 231 and 232 is formed. Wax material for sealing which is an alloy of, for example, silver and copper (Ag—Cu alloy) may be used as the material of the sealing members 231 and 232. Since the sealing members 231 and 232 are heated by lighting heat from the lamp 1 while ultraviolet rays are irradiated to the sealing members 231 and 232 when the lamp 1 is lit, material which has ultraviolet light resistance and thermal resistance may be used as that of the sealing members 231 and 232. In particular, material with little absorption of fluorine ions, such as an alloy of silver and copper (Ag—Cu alloy), can suitably used.

A gas pipe 2221 is provided in the second lid portion member 222. After air is discharged from an inner space 24 of an electric discharge container 2 via the gas pipe 2221 so that the pressure thereof is decreased, rare gas and a fluoride with high chemical stability is filled in as a light emitting gas. After the enclosure of the light emitting gas, the sealing portion 2222 is formed by performing, for example, a pressure welding etc. to a gas pipe 2221, so that the electric discharge container 2 is formed as a sealed structure. The light emitting gas enclosed in the inner space 24 of the electric discharge container 2 may be rare gas which is, for example, argon (Ar), krypton (Kr), or xenon (Xe), and a fluoride which is, for example, sulfur hexafluoride ($SF_6$), carbon tetrafluoride ($CF_4$), or nitrogen trifluoride ($NF_3$).

While, as shown in FIG. 5B, three external electrodes 31, 32, and 33 are arranged on the outer surface of the arc tube 21 so as to be electrically separated from one another, as shown in FIG. 5A, they are provides so as to extend along the tube axis direction of the arc tube 21. Furthermore, the external electrodes 31, 32, and 33 are provided so as to be separated from the sealing members 231 and 232 and the lid portion members 221 and 222. As shown in FIG. 5A, in the first external electrode 31, a portion L6 where the first external electrode 31 does not face the second external electrode 32 is formed in a side of the first lid portion member 221 in the longitudinal direction of the arc tube. Moreover, in the second external electrode 32, a portion L7 where the second external electrode 32 does not face the first external electrode 31 is formed in a side of the second lid portion member 222 in the longitudinal direction of the arc tube. As described below, in order to electrically connect the first external electrode 31 and leads 41 and 43 to each other, in the third external electrode 33, a portion L6 where the third external electrode 33 does not face the second external electrode 32, is formed in a side of the first lid portion member 221 in the longitudinal direction of the arc tube. That is, the third external electrode 33 is formed so as to face the first external electrode 31 in the longitudinal direction.

The external electrodes 31, 32, and 33 can be formed by applying material, such as copper in form of paste, to the outer surface of the arc tube 21. Moreover, strip-shaped aluminum can also be pasted on the outer surface of the arc tube 21 with an adhesive agent etc.

An insulator 6 is formed so as to respectively cover the outside of the external electrodes 31, 32, and 33 provided on the outer surface of the arc tube 21. As shown in FIG. 5A, the insulator 6 is formed in the tube axis direction of the arc tube 21, so as to extend over a portions L1 where the external electrodes 31, 32, and 33 face one another in the tube axis direction of the arc tube 21. Moreover, as shown in FIG. 5B, in the circumferential direction of the arc tube 21, the insulator 6 is formed so as to cover outer portions L41, each of which is located within portions L31 extending between two of the external electrodes 31, 32, and 33 which face one another on the outer circumferential surface of the arc tube 21 but each of which is located outside the external electrodes 31, 32, and 33 in the circumferential direction of the outer circumferential surface of the arc tube 21, and outer portions L5, each of which is located outside the external electrodes 31, 32, and 33 in a diameter direction of the arc tube 21. The insulator 6 is formed by applying paste in which, for example, silica particles are dispersed in organic solvent, so as to cover the outside portions of the external electrodes 31, 32, and 33, and then sintering it. Moreover, material having a dielectric constant lower than that of the external electrodes 31, 32, and 33 is used for the insulator 6. In particular, if the dielectric constant of the material of the insulator 6 is lower than the material of the arc tube 21, it is suitably used as means for insulating the electrodes 31 32 and 33 among one another when the lamp 1 is lit.

The first lead 41 is electrically connected, by a first solder 51 etc., to a portion L61 of the first external electrode 31 which does not face the second external electrode 32, which is not covered with the insulator 6, and which is exposed to the outside. Moreover, as to the second external electrode 32, the second lead 42 is electrically connected, by the second solder 52 etc., to a portion L71 of the second external electrode 32, which does not face the first external electrode 31, which is not covered with the insulator 6, and which is exposed to the outside. As to the third external electrode 33, the third lead 43 is electrically connected, by a third solder 53 etc., to a portion L61 of the third external electrode 33, which does not face the second external electrode 32, which is not covered with the insulator 6, and which is exposed to the outside.

When voltage is impressed between the first and third external electrodes 31 and 33 to which the first and third leads 41 and 43 are connected electrically, and the second external electrode 32, at time of lighting of the lamp 1, electric discharge occurs between the second external electrode 32 and the first and third external electrodes 31 and 33 to which the first and third leads 41 and 43 are electrically connected, through the arc tube 21. When the rare gas of the light emitting gas is, for example, argon (Ar), and the fluoride is, for example, sulfur hexafluoride ($SF_6$), they are ionized so that argon ions and fluorine ions are formed, whereby excimer molecules which are made up of argon-fluorine are formed, and light having approximately 193 nm wavelength is emitted from the arc tube 21. Although not illustrated, the first lead 41 and the third lead 43 are connected electrically to each other. A power supply (not shown) is connected to the second lead 42 and the first and third leads 41 and 43 which are connected electrically to each other, so that electric power is supplied thereto when the lamp 1 is lit.

As shown in FIG. 5B, when the lamp 1 is lit, electric discharge which occurs between the second external electrode 32 and the first and third external electrodes 31 and 33, is generated through the arc tube 21 in a range L1 in the tube axis direction of the arc tube 21, in which the external electrodes 31, 32 and 33 face one another. When the arc tube 21 is made of material which does not contain silica (Si), as material with little absorption of fluorine ions, it is possible to prevent the arc tube 21 from absorbing the ionized fluorine ions.

When the external electrodes 31, 32 and 33 are provided so as to be separately placed from the sealing members 231 and 232 and the lid portion members 221 and 222 in the tube axis direction of the arc tube 21, in the inner space 24 of the electric discharge container 2, no electric discharge occurs in a range L2 extending from the end portions of the range L1 where the external electrodes 31, 32 and 33 in the tube axis direction of the arc tube 21 face one another, to the respective sealing members 231 and 232 which are located near there. For this reason, when material such as sulfur hexafluoride ($SF_6$), with high chemical stability, is filled as the light emitting gas, in the inner space 24 of the electric discharge container 2, since no electric discharge occurs in the range L2 from the end portions of the range L1 where the external electrodes 31, 32 and 33 in the direction of the tube axis of the arc tube 21 face one another, to the respective sealing members 231 and 232 which are located near there, the fluorine ions ionized by the electric discharge return to, for example, sulfur hexafluoride which was before the ionization. Thereby, in the inner space 24 of the electric discharge container 2, as compared with the range L1 where the external electrodes 31, 32 and 33 in the tube axis direction of the arc tube 21 face one another, the fluorine ions decrease extremely in the range L2 from the end portions of the range L1 where the external electrodes 31, 32 and 33 in the tube axis direction of the arc tube 21 face one another, to the respective sealing members 231 and 232 which are located near there. That is, since it is possible to suppress contacts of fluorine ions with the sealing members 231 and 232, it is possible to prevent decrease of the fluorine ions in the inner space 24 of the electric discharge container 2 when the lamp 1 is lit, and the illuminance reduction of the lamp 1 due to decrease of the fluorine ions can be prevented.

In order to use the excimer lamp 1 according to the embodiment as an ultraviolet rays light source for photochemical reaction, it is necessary to stably start electric discharge. Furthermore, generation of electrons which have high energy required for generating excimer molecules is required for the excimer lamp 1. However, the chemical stability of the fluoride enclosed in the inner space 24 of the electric discharge container 2 is high. That is, a fluoride with the high chemical stability, which is sulfur hexafluoride ($SF_6$), carbon tetrafluoride ($CF_4$), or nitrogen trifluoride ($NF_3$) is gas having high electron attachment nature (in other words, it exhibits the property of capturing electrons, largely). For this reason, since electrons produced by ionization are captured with high probability, breakdown voltage thereof becomes higher than that of the conventional lamp 1 in which fluorine ($F_2$) gas is enclosed. Furthermore, in order to generate electrons with high energy, applied voltage needs to be high. Moreover, in the case of the excimer lamp 1 according to the embodiment, in order to obtain sufficient illuminance, 100 Torr or more of light emitting gas needs to be enclosed in the electric discharge container 2. As in the excimer lamp 1 according to the first embodiment shown in FIGS. 1 and 2, in case where it has the structure in which the external electrodes 31 and 32 are provided on the outer surface of the arc tube 21, when high voltage is impressed to the external electrodes 31 and 32, the so-called creeping discharge in which discharge occurs along a surface of the arc tube 21 between the external electrodes 31 and 32, is generated.

Then, as in the excimer lamp 1 according to this embodiment, creeping discharge can be suppressed by forming the insulator 6 along the external electrodes 31, 32 and 33, in at least the portion L31 between the external electrodes 31 and 33 and the second external electrode 32 on the outer circumferential surface of the arc tube 21, but in the portions L41 of outsides of the external electrodes 31, 32 and 33 in the circumferential direction of the outer circumferential surface of the arc tube 21, between which potential difference is generated when the lamp 1 is let.

Furthermore, in case electric conductive material (for example, a work piece to which ultraviolet rays are irradiated) which is not shown, is arranged, for example, near the excimer lamp 1, when high voltage is inputted at a high frequency to the external electrodes 31, 32 and 33, electric discharge occurs toward the electric conductive material (not shown) from the external electrode 31 (32, or/and 33), so that the electric discharge between the external electrodes 31 and 33 and the second external electrode 32 may be disturbed through the arc tube 21. For this reason, since the insulator 6 is formed on the portions L5 which are located outside the external electrodes 31, 32 and 33 in the diameter direction of the arc tube 21. Furthermore, the insulator 6 is formed in a portion L32 between the first external electrode 31 and the third external electrode 33 on the outer circumferential surface of the arc tube 21, but in portions L42 which are located outside the first and third external electrodes 31 and 33 in the circumferential direction of the outer circumferential surface of the arc tube 21, between which the potential difference is not generated when the lamp 1 is lit. That is, the portions L41, L42, and L5 which are located outside the external electrodes 31, 32, and 33 respectively, can be electrically insulated by covering the external electrodes 31, 32, and 33 with the insulator 6. The excimer lamp 1 according to this embodiment, comprises the electric discharge container 2 in which the sealing members 231 and 232 are provided in the arc tube 21 which does not contain silica, and at least the pair of the external electrodes (31, 32 and 33) which are separately provided on the outer surface of the arc tube 21, wherein rare gas and a fluoride are enclosed in the electric discharge container 2, and further the fluoride is sulfur hexafluoride, carbon tetrafluoride, or nitrogen trifluoride. Since the chemical stability of the fluoride enclosed in the electric discharge container 2 is high, the ionized fluorine ions can return to a fluoride even at time of lighting of the lamp 1, in the range L2 from the end portions of the range L1 where the external electrodes 31, 32 and 33 face one another in the inner space 24 of the electric discharge container 2, to the respective sealing members which are located near there. Since it is possible to suppress contacts of the sealing members 231 and 232 and the fluorine ions, absorption of the fluorine ions in the sealing members 231 and 232 can be controlled. That is, according to the feature, in the excimer lamp 1 according to this embodiment, the illuminance fall due to the absorption of the fluorine ions in the sealing members 231 and 232 can be controlled, so that an illuminance thereof can be maintained for a long time.

Further, the external electrodes 31, 32, and 33 are covered with the insulator 6, and the insulator 6 is formed in the portions L31 between the second external electrode 32 and the first external electrodes 31 and 33, on the outer circumferential surface of the arc tube 21, but in the portions L41 which are located outside the external electrodes 31, 32 and 33 in the circumferential direction of the outer circumferential surface of the arc tube 21, between which the potential difference is not generated when the lamp 1 is lit. For this reason, in the excimer lamp 1 according to this embodiment, it is possible to suppress creeping discharge between the second external electrode 32 and the first and third external electrodes 31 and 33, on the outer surface of the electric discharge container 2.

In addition, the external electrodes 31, 32, and 33 are covered with the insulator 6, and the insulator 6 is formed on the portions L5 which are located outside the external electrodes 31, 32 and 33 in the diameter direction of the arc tube 21. Furthermore, the insulator 6 is formed in the portion L32 between the first external electrode 31 and the third external electrode 33 on the outer circumferential surface of the arc tube 21, but in the portions L42 which are located outside the first and third external electrodes 31 and 33 in the circumferential direction of the outer circumferential surface of the arc tube 21, between which the potential difference is not generated at the time of lighting of the lamp 1. For this reason, in the excimer lamp 1 according to this embodiment, it is possible to electrically insulate the external electrodes 31, 32, and 33 in the outside portions L41, L42, and L5.

Figure 6:
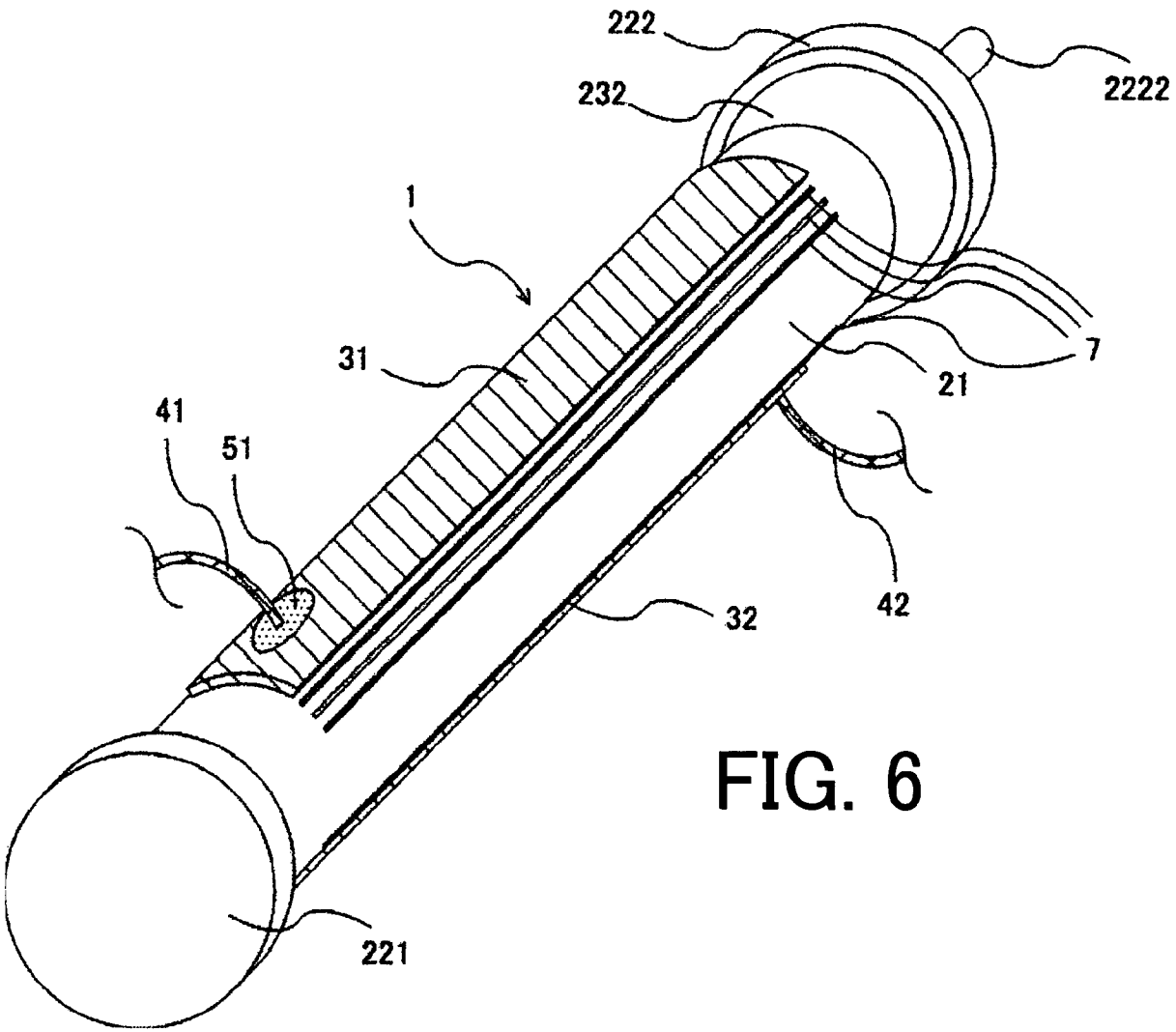
FIG. 6 is a diagram of an excimer lamp according to a third embodiment.
Figure 7A:
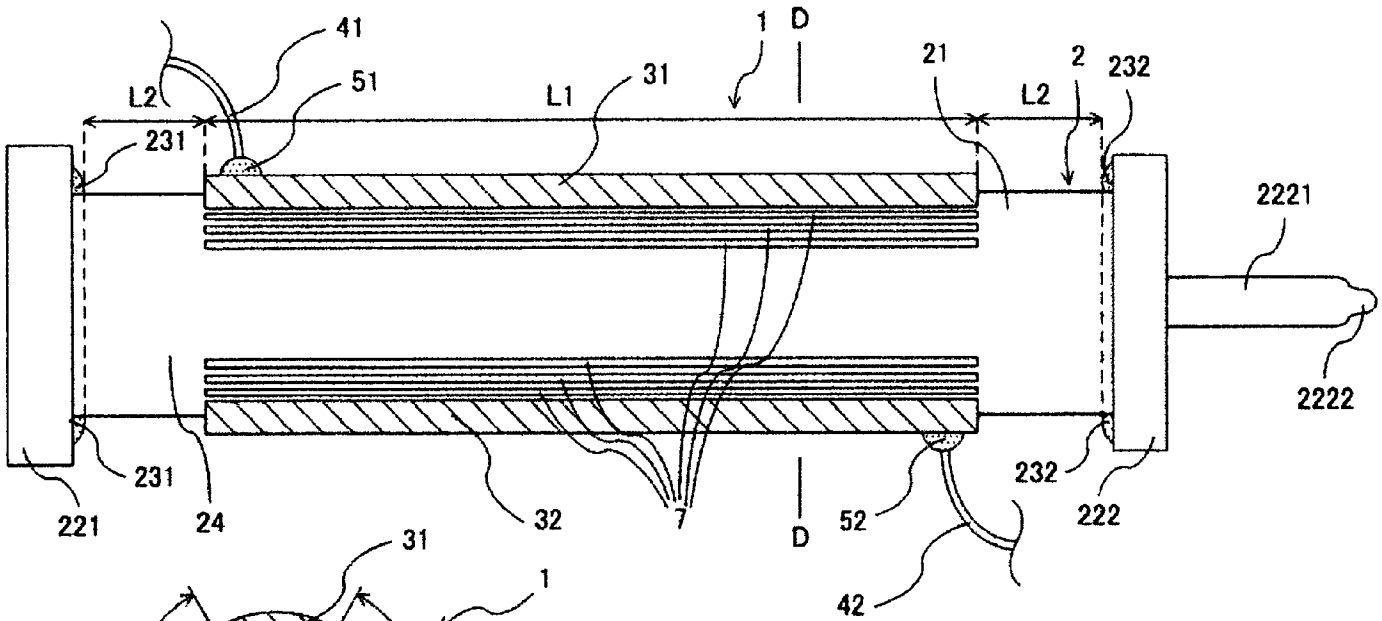
FIGS. 7A and 7B are diagrams of an excimer lamp according to a third embodiment.
Figure 7B:
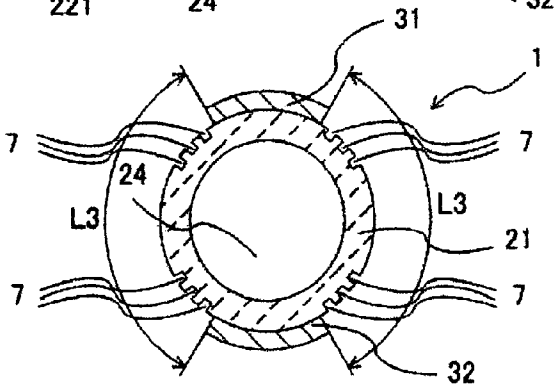

A third embodiment of the excimer lamp 1 is described, referring to FIGS. 6, 7A and 7B.

FIGS. 6, 7A and 7B are explanatory diagrams of an excimer lamp 1 according to the embodiment. FIG. 6 is a perspective view of the excimer lamp 1. FIG. 7A is a side elevational view of the excimer lamp 1 (a side elevational diagram, viewing a portion L3 between a first external electrode 31 and a second external electrodes 32) which is viewed perpendicularly to the tube axis direction of an arc tube 21. FIG. 7B is a cross sectional view thereof (taken along a line D-D of FIG. 7A), taken along a direction perpendicular to the tube axis direction of the arc tube 21 of FIG. 7A. In FIGS. 6, 7A and 7B, the same reference numerals as those of FIG. 2 are assigned to structural parts which are the same as those shown in FIG. 2.

The excimer lamps 1 shown in FIGS. 6, 7A and 7B is different from the excimer lamp 1 shown in FIGS. 1, 2A and 2B, in that grooves 7 are formed in portions L3 between the external electrodes 31 and 32. FIGS. 6, 7A and 7B will be described in terms of differences between the excimer lamp of FIGS. 1 and 2 and that of FIGS. 6, 7A and 7B.

The arc tube 21 of the excimer lamp 1 according to this embodiment is in a shape of a straight pipe, which is made of material having optical permeability with respect to 150-400 nm, and having little absorption of fluorine ions. The material of the arc tube 21, is, for example, a metal oxide such as sapphire (single crystal alumina), or alumina (polycrystal alumina), whose principal component is an aluminum oxide ($A_2O_3$). In addition, a fluoride such as magnesium difluoride ($MgF_2$), lithium fluoride (LiF), calcium difluoride ($CaF_2$), barium difluoride ($BaF_2$), or YAG (yttrium aluminum garnet) can be used as the material of the arc tube 21. In addition, although quartz glass ($SiO_2$) may be selected as the material having the optical permeability, since silica (Si) contained in quartz glass ($SiO_2$) has high reactivity with fluorine ions, the quartz glass ($SiO_2$) might not be used as the material of the arc tube 21 which is brought into contact with fluorine ions when the lamp 1 is lit. For this reason, material which does not contain silica (Si) is suitably used for the arc tube 21 which is made of material having little absorption of fluorine ions.

The arc tube 21 is opened at both ends in the longitudinal direction thereof, and cup-like lid portion members 221 and 222 are arranged at the both ends. The lid portion members 221 and 222 are formed of the so-called kovar, an alloy in which nickel (Ni) and cobalt (Co) is blended with iron (Fe). The material of the lid portion members 221 and 222 is not limited to such a metal. Since all that is required is that the material has ultraviolet light resistance, the lid portion members 221 and 222 may be made of material which is the same as that of the arc tube 21, that is, for example, sapphire (single crystal alumina) whose main component is aluminum oxide ($A_2O_3$) etc.

Since sealing members 231 and 232 are filled up between the arc tube 21 and the respective lid portion members 221 and 222, the arc tube 21 and the lid portion members 221 and 222 are respectively connected to each other, so that the electric discharge container 2 which is made up of the arc tube 21, the lid portion members 221 and 222, and the sealing members 231 and 232 is formed. Wax material for sealing which is made up of an alloy of, for example, silver and copper (Ag—Cu alloy) may be used as the material of the sealing members 231 and 232. Since the sealing members 231 and 232 are heated by lighting heat from the lamp 1 while ultraviolet rays are irradiated to the sealing members 231 and 232 when the lamp 1 is lit, material which has ultraviolet light resistance and thermal resistance may be used as that of the sealing members 231 and 232. In particular, material with little absorption of fluorine ions, such as an alloy of silver and copper (Ag—Cu alloy), can suitably used.

A gas pipe 2221 is provided to the second lid portion member 222. After air is discharged from the inner space 24 of the electric discharge container 2 via the gas pipe 2221 so that the pressure thereof is decreased, rare gas and a fluoride with high chemical stability is enclosed as a light emitting gas. After the enclosure of the light emitting gas, the sealing portion 2222 is formed by performing, for example, a pressure welding etc. to a gas pipe 2221, so that the electric discharge container 2 is formed as a sealed structure. The light emitting gas enclosed in the inner space 24 of the electric discharge container 2 may be rare gas which is, for example, argon (Ar), krypton (Kr), or xenon (Xe), and a fluoride which is, for example, sulfur hexafluoride ($SF_6$), carbon tetrafluoride ($CF_4$), or nitrogen trifluoride ($NF_3$).

While, as shown in FIG. 7B, a pair of external electrodes 31 and 32 are arranged on the outer surface of the arc tube 21 so as to be electrically separated from each other, as shown in FIG. 7A, they are provides so as to extend along the tube axis direction of the arc tube 21. Furthermore, the external electrodes 31 and 32 are provided so as to be separated from the sealing members 231 and 232 and the lid portion members 221 and 222.

The external electrodes 31 and 32 can be formed by applying material, such as copper in form of paste, to the outer surface of the arc tube 21. Moreover, for example, strip-shaped aluminum can also be pasted on the outer surface of the arc tube 21 with an adhesive agent etc. Each of the leads 41 and 42 is electrically connected to one end of the external electrode with solder 51 or 52 etc. in a longitudinal direction of the external electrodes 31 and 32. A power supply (not shown) is connected to the leads 41 and 42, and electric power is supplied when the lamp 1 is lit.

On the outer surface of the arc tube 21, the grooves 7 are provided between the external electrodes 31 and 32. In the tube axis direction of the arc tube 21, as shown in FIG. 7A, the grooves 7 are formed so as to extend over a range L1 where the external electrodes 31 and 32 face each other in the tube axis direction of the arc tube 21. Moreover, as shown in FIG. 7B, in the circumferential direction of the arc tube 21, the grooves 7 are provided in the portions L3 between the external electrodes 31 and 32 which face each other on the outer circumferential surface of the arc tube 21. The grooves 7 can be formed by irradiating laser to the outer surface of the arc tube 21 made up of, for example, sapphire (single crystal alumina) whose principal component is aluminum oxide ($A_2O_3$).

Electric discharge occurs between the pair of external electrodes 31 and 32 through the arc tube 21 by impressing voltage between the external electrodes 31 and 32 when the lamp 1 is lit. When the rare gas of the light emitting gas is, for example, argon (Ar), and the fluoride is, for example, sulfur hexafluoride ($SF_6$), they are ionized so that argon ions and fluorine ions are formed, whereby excimer molecules which are made up of argon-fluorine is formed, and light having approximately 193 nm wavelength is emitted from the arc tube 21.

As shown in FIG. 7B, when the lamp 1 is lit, electric discharge which occurs between the external electrodes 31 and 32 is generated through the arc tube 21 in a range L1 in the tube axis direction of the arc tube 21, in which the external electrodes 31 and 32 face each other. When the arc tube 21 is made of material which does not contain silica (Si), as material with little absorption of fluorine ions, it is possible to prevent the arc tube 21 from absorbing the ionized fluorine ions.

When the external electrodes 31 and 32 are provided so as to be separately placed from the sealing members 231 and 232 and the lid portion members 221 and 222 in the tube axis direction of the arc tube 21, no electric discharge occurs, in a range L2 extending from the end portions of the range L1 where the external electrodes 31 and 32 in the tube axis direction of the arc tube 21 face each other, to the sealing members 231 and 232 which are located near there, in the inner space 24 of the electric discharge container 2. For this reason, when material such as sulfur hexafluoride ($SF_6$), with high chemical stability, is filled as the light emitting gas, in the inner space 24 of the electric discharge container 2, since no electric discharge occurs in the range L2 from the end portions of the range L1 where the external electrodes 31 and 32 in the direction of the tube axis of the arc tube 21 face each other, to the sealing members 231 and 232 which are located near there, the fluorine ions ionized by the electric discharge return to, for example, sulfur hexafluoride which was before the ionization. Thereby, in the inner space 24 of the electric discharge container 2, as compared with the range L1 where the external electrodes 31 and 32 in the tube axis direction of the arc tube 21, face each other, the fluorine ions decrease extremely in the range L2 from the end portions of the range L1 where the external electrodes 31 and 32 in the tube axis direction of the arc tube 21 face each other, to the sealing members 231 and 232 which are located near there. That is, since it is possible to suppress contacts of fluorine ions with the sealing members 231 and 232, it is possible to prevent decrease of the fluorine ions in the inner space 24 of the electric discharge container 2 when the lamp 1 is lit, and the illuminance reduction of the lamp 1 due to decrease of the fluorine ions can be prevented.

In order to use the excimer lamp 1 according to the embodiment as an ultraviolet rays light source for photochemical reaction, it is necessary to stably start electric discharge. Furthermore, generation of electrons which have high energy required for generating excimer molecules is required for the excimer lamp 1. However, the chemical stability of the fluoride enclosed in the inner space 24 of the electric discharge container 2 is high. That is, a fluoride with the high chemical stability, which is sulfur hexafluoride ($SF_6$), carbon tetrafluoride ($CF_4$), or nitrogen trifluoride ($NF_3$) is gas having high electron attachment nature (in other words, it exhibits the property of capturing electrons, largely). For this reason, since electrons produced by ionization are captured with high probability, breakdown voltage thereof becomes higher than that of the conventional lamp 1 in which fluorine ($F_2$) gas is enclosed. Furthermore, in order to generate electrons with high energy, applied voltage needs to be high. Moreover, in the case of the excimer lamp 1 according to the embodiment, in order to obtain sufficient illuminance, 100 Torr or more of light emitting gas needs to be enclosed in the electric discharge container 2. As in the excimer lamp 1 according to the first embodiment shown in FIGS. 1, 2A and 2B, in case where it has the structure in which the external electrodes 31 and 32 are provided on the outer surface of the arc tube 21, when high voltage is impressed to the external electrodes 31 and 32, the so-called creeping discharge in which discharge occurs along a surface of the arc tube 21 between the external electrodes 31 and 32, is generated.

Further, as shown in the excimer lamp 1 according to this embodiment, in the circumferential direction of the arc tube 21, since the grooves 7 are formed along the longitudinal direction of the external electrodes 31 and 32 on at least the portions L3 between the external electrodes 31 and 32 which face each other on the outer circumferential surface of the arc tube 21, it is possible to suppress the creeping discharge. That is, when the grooves 7 are formed, since the creeping distance between the external electrodes 31 and 32 in the outer circumferential surface of the arc tube 21 which face each other is extended, the creeping discharge can be suppressed.

The excimer lamp 1 according to this embodiment, comprises the electric discharge container 2 in which the sealing members 231 and 232 are provided in the arc tube 21 which does not contain silica, and at least a pair of the external electrodes 31 and 32 which are separately provided on the outer surface of the arc tube 21, wherein rare gas and a fluoride are enclosed in the electric discharge container 2, and the fluoride is sulfur hexafluoride, carbon tetrafluoride, or nitrogen trifluoride. Since the chemical stability of the fluoride enclosed in the electric discharge container 2 is high, the ionized fluorine ion can return to a fluoride even at time of lighting of the lamp 1, in the range L2 from the end portions of the range L1 where the external electrodes 31 and 32 face each other in the inner space 24 of the electric discharge container 2, to the respective sealing members which are located near there. Since it is possible to control contacts of the sealing members 231 and 232 and the fluorine ions, absorption of the fluorine ions in the sealing members 231 and 232 can be suppressed. That is, according to the feature, in the excimer lamp 1 according to this embodiment, the illuminance fall due to the absorption of the fluorine ions in the sealing members 231 and 232 can be suppressed, so that an illuminance thereof can be maintained for a long time.

When the grooves 7 are formed between the external electrodes 31 and 32 which face each other on the outer surface of the arc table 21, the creeping distance between the external electrodes 31 and 32 on the outer surface of the arc tube 21 can be extended. For this reason, the creeping discharge between the electrodes 31 and 32 on the outer surface of the electric discharge container 2 can be suppressed.

Figure 8A:
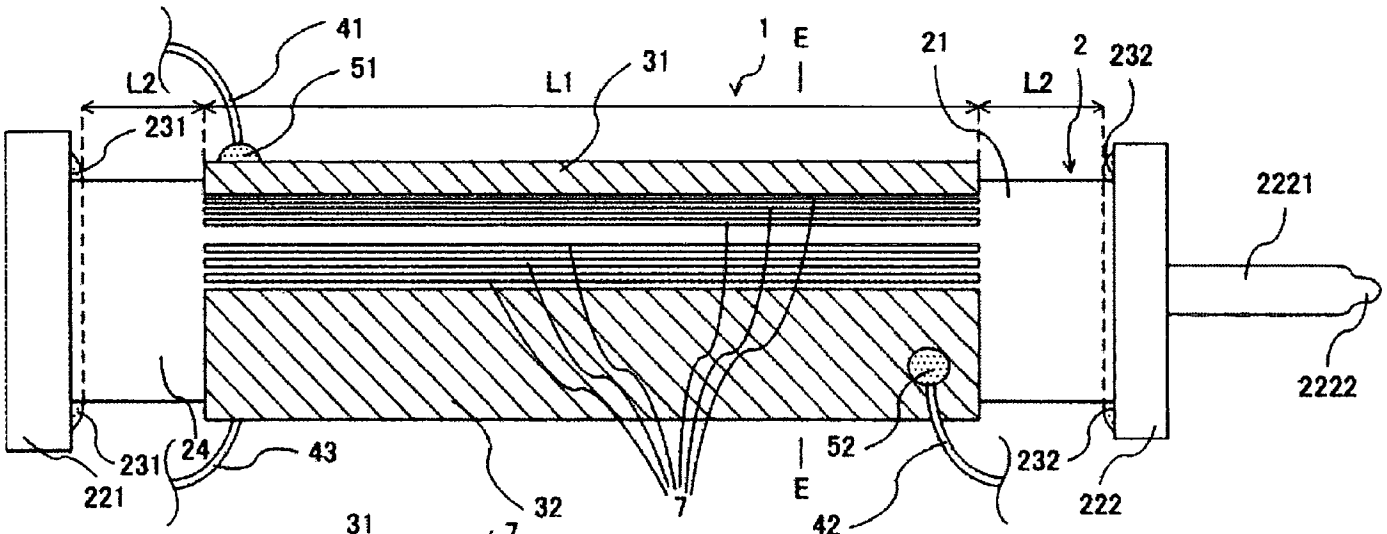
FIGS. 8A and 8B are diagrams of an excimer lamp of another form according to a third embodiment.
Figure 8B:
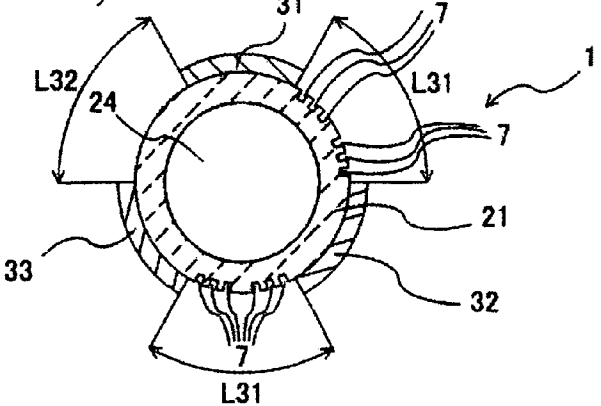

Another form of the third embodiment of an excimer lamp 1 is described, referring to FIGS. 8A and 8B.

FIGS. 8A and 8B are explanatory diagrams of the excimer lamp 1 according to the embodiment. FIG. 8A is a side elevational view of the excimer lamp 1 (a side elevational diagram, viewing from a side of the second external electrode 32) which is viewed perpendicularly to a direction of the tube axis of the arc tube 21. FIG. 8B is a cross sectional view thereof (taken along a line E-E of FIG. 8A), taken along a direction perpendicular to the tube axis direction of the arc tube 21 of FIG. 8A. In FIGS. 8A and 8B, the same reference numerals as those of FIGS. 7A and 7B are assigned to structural parts which are the same as those shown in FIGS. 7A and 7B.

The excimer lamp 1 shown in FIGS. 8A and 8B is different from that shown in FIGS. 6, 7A and 7B, in that in FIGS. 8A and 8B, three external electrodes 31, 32, and 33 are provided. FIGS. 8A and 8B will be described in terms of differences between the excimer lamp of FIGS. 6, 7A and 7B and that of FIGS. 8A and 8B.

The arc tube 21 of the excimer lamp 1 according to this embodiment is in a shape of a straight pipe, which is made of material having optical permeability with respect to 150-400 nm, and having little absorption of fluorine ions. The material of the arc tube 21, is, for example, a metal oxide such as sapphire (single crystal alumina), or alumina (polycrystal alumina), whose principal component is an aluminum oxide ($A_2O_3$). In addition, a fluoride such as magnesium difluoride ($MgF_2$), lithium fluoride (LiF), calcium difluoride ($CaF_2$), barium difluoride ($BaF_2$), or YAG (yttrium aluminum garnet) can be used as the material of the arc tube 21. In addition, although quartz glass ($SiO_2$) may be selected as the material having the optical permeability, since silica (Si) contained in quartz glass ($SiO_2$) has high reactivity with fluorine ions, the quartz glass ($SiO_2$) might not be used as the material of the arc tube 21 which is brought into contact with fluorine ions when the lamp 1 is lit. For this reason, material which does not contain silica (Si) is suitably used for the arc tube 21 which is made of material having little absorption of fluorine ions.

The arc tube 21 is opened at both ends in the longitudinal direction thereof, and cup-like lid portion members 221 and 222 are arranged at the both ends. The lid portion members 221 and 222 are formed of the so-called kovar, an alloy in which nickel (Ni) and cobalt (Co) is blended with iron (Fe). The material of the lid portion members 221 and 222 is not limited to such a metal. Since all that is required is that the material has ultraviolet light resistance, the lid portion member 221 and 222 may be made of material which is the same as that of the arc tube 21, that is, for example, sapphire (single crystal alumina) whose main component is aluminum oxide ($A_2O_3$) etc.

Since sealing members 231 and 232 are filled up between the arc tube 21 and the lid portion members 221 and 222, respectively, the arc tube 21 and the lid portion members 221 and 222 are respectively connected to each other, so that the electric discharge container 2 which is made up of the arc tube 21, the lid portion members 221 and 222, and the sealing members 231 and 232 is formed. Wax material for sealing which consists of an alloy of, for example, silver and copper (Ag—Cu alloy) may be used as the material of the sealing members 231 and 232. Since the sealing members 231 and 232 are heated by lighting heat from the lamp 1 while ultraviolet rays are irradiated to the sealing members 231 and 232 when the lamp 1 is lit, material which has ultraviolet light resistance and thermal resistance may be used as that of the sealing members 231 and 232. In particular, material with little absorption of fluorine ions, such as an alloy of silver and copper (Ag—Cu alloy), can suitably used.

A gas pipe 2221 is provided to the second lid portion member 222. After air is discharged from an inner space 24 of the electric discharge container 2 via the gas pipe 2221 so that the pressure thereof is decreased, rare gas and a fluoride with high chemical stability is enclosed as a light emitting gas. After the enclosure of the light emitting gas, the sealing portion 2222 is formed by performing, for example, a pressure welding etc. to a gas pipe 2221, so that the electric discharge container 2 is formed as a sealed structure. The light emitting gas enclosed in the inner space 24 of the electric discharge container 2 may be rare gas which is, for example, argon (Ar), krypton (Kr), or xenon (Xe), and a fluoride which is, for example, sulfur hexafluoride ($SF_6$), carbon tetrafluoride ($CF_4$), or nitrogen trifluoride ($NF_3$)

While, as shown in FIG. 8B, three external electrodes 31, 32, and 33 arranged on the outer surface of the arc tube 21, so as to be electrically separated from one another, as shown in FIG. 8A, they are provided so as to extend along a direction of the tube axis of the arc tube 21. Furthermore, the external electrodes 31, 32, and 33 are provided so as to be separated from the sealing members 231 and 232 and the lid portion members 221 and 222.

The external electrodes 31, 32 and 33 can be formed by applying material, such as copper in form of paste, to the outer surface of the arc tube 21. Moreover, for example, strip-shaped aluminum can also be pasted on the outer surface of the arc tube 21 with an adhesive agent etc. Each of the leads 41, 42 and 43 is electrically connected to one end of the external electrode with solder 51, 52 or 53 etc. in a longitudinal direction of the external electrodes 31 32 and 33. Although not illustrated, the first lead 41 connected to the first external electrode 31 and the third lead 43 connected to the third external electrode 33 are connected electrically to each other. A power supply (not shown) is connected to the first and third leads 41 and 43 electrically connected to each other and the second lead 42, and electric power is supplied when the lamp 1 is lit.

On the outer surface of the arc tube 21, the grooves 7 are provided between the first and second external electrodes 31 and 32, and the second and third external electrodes 32 and 33. In the tube axis direction of the arc tube 21, as shown in FIG. 8A, the grooves 7 are formed so as to extend over a range L1 where the external electrodes 31, 32 and 33 face each other, in the tube axis direction of the arc tube 21. Moreover, as shown in FIG. 8B, in the circumferential direction of the arc tube 21, the grooves 7 are respectively provided in portions L31 between the first and second external electrodes 31 and 32, and the second and third external electrodes 32 and 33 on the outer circumferential surface of the arc tube 21. The grooves 7 can be formed by irradiating laser to the outer surface of the arc tube 21 made up of, for example, sapphire (single crystal alumina) whose principal component is aluminum oxide ($A_2O_3$).

Voltage is impressed between and the second external electrode 32 and the first and third external electrodes 31 and 33 to which the first and third leads 41 and 43 are connected electrically when the lamp 1 is lit, whereby electric discharge occurs, through the arc tube 21, between the second external electrode 32 and the first and third external electrodes 31 and 33 to which the first and third leads 41 and 43 are electrically connected. When the rare gas of the light emitting gas is, for example, argon (Ar), and the fluoride is, for example, sulfur hexafluoride ($SF_6$), they are ionized so that argon ions and fluorine ions are formed, whereby excimer molecules which are made up of argon-fluorine is formed, and light having approximately 193 nm wavelength is emitted from the arc tube 21.

As shown in FIG. 8B, when the lamp 1 is lit, electric discharge which occurs between the second external electrodes 32 and the first and third external electrodes 31 and 33 is generated through the arc tube 21 in the range L1 in the tube axis direction of the arc tube 21, in which the external electrodes 31, 32 and 33 face one another. When the arc tube 21 is made of material which does not contain silica (Si), as material with little absorption of fluorine ions, it is possible to prevent the arc tube 21 from absorbing the ionized fluorine ions.

When the external electrodes 31, 32 and 33 are provided so as to be separately placed from the sealing members 231 and 232 and the lid portion members 221 and 222 in the tube axis direction of the arc tube 21, in the inner space 24 of the electric discharge container 2, no electric discharge occurs in a range L2 extending from the end portions of the range L1 where the external electrodes 31, 32 and 33 in the tube axis direction of the arc tube 21 face one another, to the sealing members 231 and 232 which are located near there. For this reason, when material such as sulfur hexafluoride ($SF_6$), with high chemical stability, is filled as the light emitting gas, in the inner space 24 of the electric discharge container 2, since no electric discharge occurs in the range L2 from the end portions of the range L1 where the external electrodes 31, 32 and 33 in the direction of the tube axis of the arc tube 21 face one another, to the respective sealing members 231 and 232 which are located near there, the fluorine ions ionized by the electric discharge return to, for example, sulfur hexafluoride which was before the ionization. Thereby, in the inner space 24 of the electric discharge container 2, as compared with the range L1 where the external electrodes 31, 32 and 33 in the tube axis direction of the arc tube 21, face one another, the fluorine ions decrease extremely in the range L2 from the end portions of the range L1 where the external electrodes 31, 32 and 33 in the tube axis direction of the arc tube 21 face one another, to the sealing members 231 and 232 which are located near there. That is, since it is possible to suppress contacts of fluorine ions with the sealing members 231 and 232, it is possible to prevent decrease of the fluorine ions in the inner space 24 of the electric discharge container 2 when the lamp 1 is lit, and the illuminance reduction of the lamp 1 due to decrease of the fluorine ions can be prevented.

In order to use the excimer lamp 1 according to the embodiment as an ultraviolet rays light source for photochemical reaction, it is necessary to stably start electric discharge. Furthermore, generation of electrons which have high energy required for generating excimer molecules is required for the excimer lamp 1. However, the chemical stability of the fluoride enclosed in the inner space 24 of the electric discharge container 2 is high. That is, a fluoride with the high chemical stability, which is sulfur hexafluoride ($SF_6$), carbon tetrafluoride ($CF_4$), or nitrogen trifluoride ($NF_3$) is gas having high electron attachment nature (in other words, it exhibits the property of capturing electrons, largely). For this reason, since electrons produced by ionization are captured with high probability, breakdown voltage thereof becomes higher than that of the conventional lamp 1 in which fluorine ($F_2$) gas is enclosed. Furthermore, in order to generate electrons with high energy, applied voltage needs to be high. Moreover, in the case of the excimer lamp 1 according to the embodiment, in order to obtain sufficient illuminance, 100 Torr or more of light emitting gas needs to be enclosed in the electric discharge container 2. As in the excimer lamp 1 according to the first embodiment shown in FIGS. 1, 2A and 2B, in case where it has the structure in which the external electrodes 31 and 32 are provided on the outer surface of the arc tube 21, when high voltage is impressed to the external electrodes 31 and 32, the so-called creeping discharge in which discharge occurs along a surface of the arc tube 21 between the external electrodes 31 and 32, is generated.

As in the excimer lamp 1 according to this embodiment, at least on the outer surface of the arc tube 21, the grooves 7 are provided in the circumferential direction of the arc tube 21 and extends along the longitudinal direction of the external electrodes 31, 32 and 33, in the portion 31L between the second external electrode 32 and the first and third external electrodes 31 and 33, so that it is possible to suppress creeping discharge. That is, when the grooves 7 are formed between the first and second external electrodes 31 and 32 and between the second and third external electrodes 32 and 33 where potential difference is generated when the lamp 1 is lit, creeping distances between the first and second external electrodes 31 and 32, and between the second and third external electrodes 32 and 33 are extended, so that it is possible to suppress the creeping discharge.

In addition, it is not necessary to form grooves in the portion L32 between the first external electrode 31 and the third external electrode 33 on the outer circumferential surface of the arc tube 21, since potential difference is not generated there when the lamp 1 is lit.

The excimer lamp 1 according to this embodiment, comprises the electric discharge container 2 in which the sealing members 231 and 232 are provided in the arc tube 21 which does not contain silica, and at least external electrodes 31, 32 and 33 which are separately provided from one another on the outer surface of the arc tube 21, wherein rare gas and a fluoride are enclosed in the electric discharge container 2, and further the fluoride is sulfur hexafluoride, carbon tetrafluoride, or nitrogen trifluoride. Since the chemical stability of the fluoride enclosed in the electric discharge container 2 is high, the ionized fluorine ions can return to a fluoride even at time of lighting of the lamp 1, in the range L2 from the end portions of the range L1 where the external electrodes 31, 32 and 33 face one another in the inner space 24 of the electric discharge container 2, to the respective sealing members which are located near there. Since it is possible to control contacts of the sealing members 231 and 232 and the fluorine ions, absorption of the fluorine ions in the sealing members 231 and 232 can be suppressed. That is, according to the feature, in the excimer lamp 1 according to this embodiment, the illuminance fall due to the absorption of the fluorine ions in the sealing members 231 and 232 can be suppressed, so that an illuminance thereof can be maintained for a long time.

When on the outer surface of the arc tube 21, the grooves 7 are provided between the first and second external electrodes 31 and 32, and the second and third external electrodes 32 and 33, creeping distance between the first and second external electrodes 31 and 32, and between the second and third external electrodes 32 and 33 can be extended. Therefore, it is possible to suppress the creeping discharge between the second external electrodes and the first and third electrodes 31 and 33 on the outer surface of electric discharge container 2.

In order to check the effects of the excimer lamp 1 according to the embodiments, the following Experiments 1 and 2 were conducted.

Experiment 1

In the Experiment 1, the effects of the excimer lamp 1 according to the first embodiment were checked.

Figure 11:
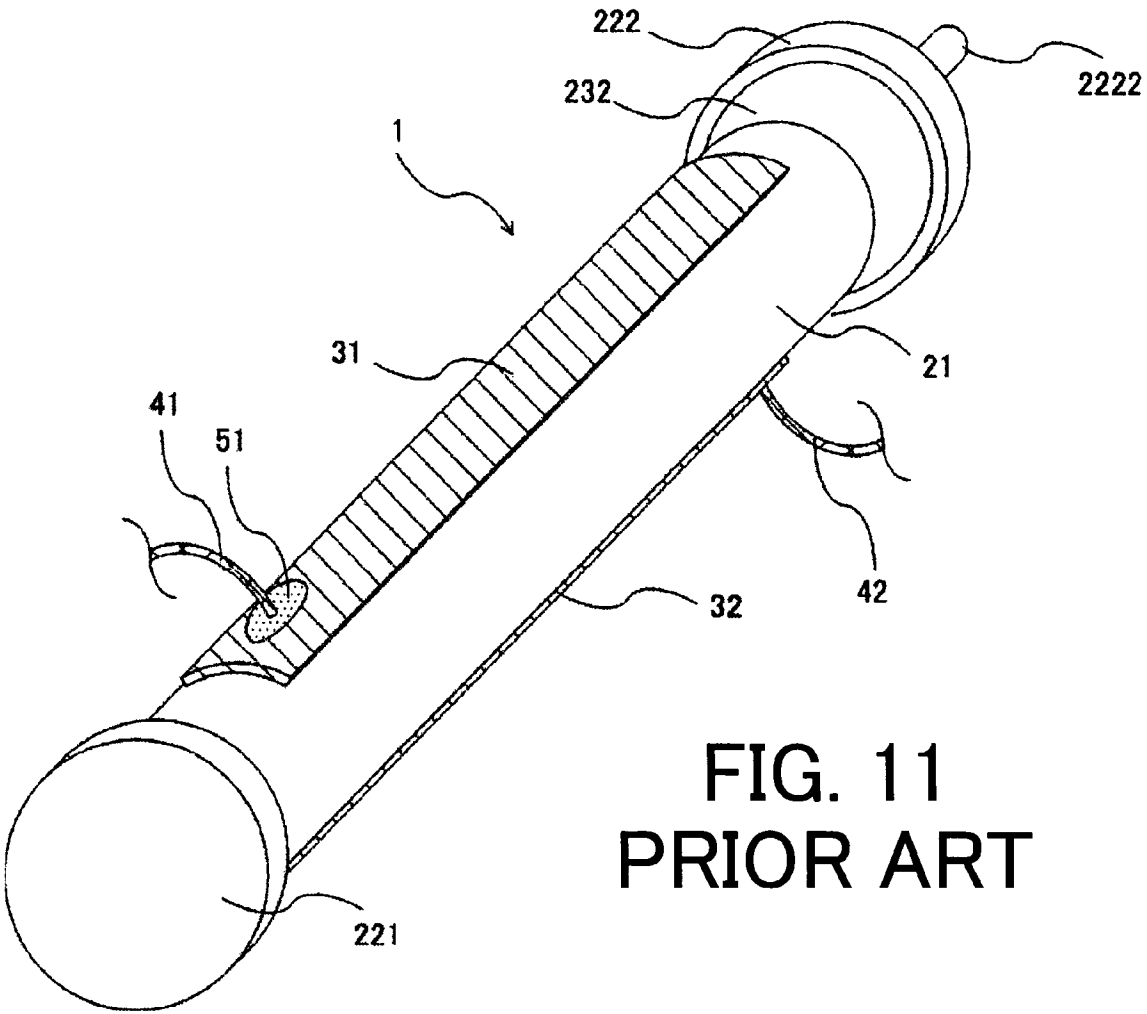
FIG. 11 PRIOR ART
FIG. 11 is a diagram of an excimer lamp according to the prior art.
Figure 12A:
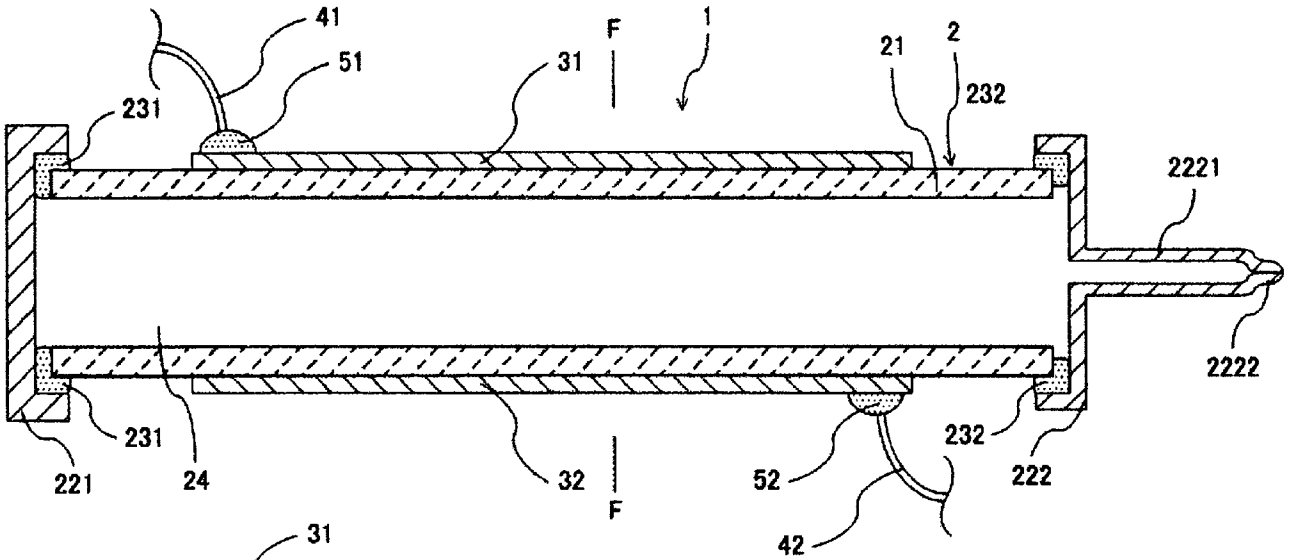
FIG. 12A PRIOR ART
FIGS. 12A and 12B are diagrams of an excimer lamp according to the prior art.
Figure 12B:
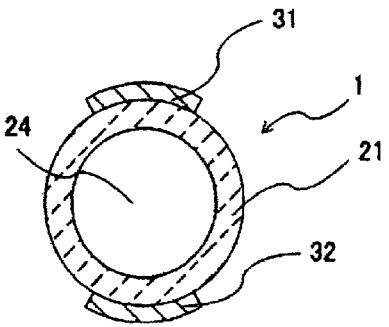
FIG. 12B PRIOR ART

As Comparative Example 1, an excimer lamp 1 of the prior art shown in FIGS. 11, 12A and 12B was prepared, in which 100 Torr of argon (Ar) and a fluorine (F2) was enclosed in the inner space 24 of the electric discharge container 2. The amount (99.9%) of argon (Ar) and that (0.1%) of the fluorine ($F_2$) was enclosed. The wax material which was made up of an alloy (Ag—Cu alloy) of silver and copper was used for the sealing members 231 and 232.

The excimer lamp 1 according to the first embodiment, shown in FIGS. 1, 2A and 2B, was prepared, in which 100 Torr of argon (Ar) and a sulfur hexafluoride ($SF_6$) was enclosed in the inner space 24 of the electric discharge container 2. The amount (99.9%) of the argon (Ar) and that of (0.1%) the sulfur hexafluoride ($SF_6$) was enclosed. The wax material which was made up of an alloy (Ag—Cu alloy) of silver and copper was used for the sealing members 231 and 232.

While impressing voltage of 3 kV to the external electrodes 31 and 32 of the excimer lamp 1 of the Comparative Example 1 and that of the first embodiment, each illuminance was measured, and further a period (life span) in which the illuminance could be maintained was measured.

FIG. 9 shows a table of the experimental result. The optical intensity shown in FIG. 9 represents the relative value when the illuminance of the Comparative Example 1 is set to a reference value.

As shown in FIG. 9, in the Comparative Example 1, the illuminance could not be maintained in 10 hours. This is considered to be due to absorption of the ionized fluorine ions by the sealing members 231 and 232.

On the other hand, since in the excimer lamp 1 according to the first embodiment, energy is required to ionize the sulfur hexafluoride ($SF_6$), the illuminance was decreased. However, the illuminance could be maintained for 1,000 hours or more. It is considered that since the chemical stability of the sulfur hexafluoride ($SF_6$) is high, the ionized fluorine ions could return to sulfur hexafluoride ($SF_6$), whereby absorption thereof in the sealing members 231 and 232 could be suppressed. Therefore, in the excimer lamp 1 according to the first embodiment, since a fluoride having high chemical stability was used as the light emitting gas, it was possible to suppress absorption of fluorine ions in the sealing members 231 and 232 so that the illuminance could be maintained for a long time.

Experiment 2

In Experiment 2, it was checked whether even if the excimer lamp 1 according to the second and third embodiments was operated with the illuminance of the excimer lamp 1 of the prior art, creeping discharge would be prevented and the illuminance would be maintained.

As Comparative Example 1, the excimer lamp 1 of the prior art shown in FIGS. 11, 12A and 12B was prepared, and 100 Torr of argon (Ar) and fluorine (F2) was filled in the inner space 24 of the electric discharge container 2. The amount (99.9%) of the argon (Ar) and that of (0.1%) the fluorine ($F_2$) was enclosed. Wax material which was made up of an alloy (Ag—Cu alloy) of silver and copper was used for the sealing members 231 and 232. This lamp 1 was the same as that of the Comparative Example 1 used for Experiment 1. The outer diameter of the arc tube 21 was 10 mm, and the voltage impressed to the external electrodes 31 and 32 was 5 kV when the lamp 1 is lit.

Moreover, an excimer lamp 1 according to the first embodiment shown in FIGS. 1, 2A and 2B was prepared as Comparative Example 2, in which 100 Torr of argon (Ar) and sulfur hexafluoride ($SF_6$) was filled in the inner space 24 of the electric discharge container 2. The amount of (99.9%) argon (Ar) and that (0.1%) of the sulfur fluoride (SF6) was enclosed therein. Wax material which was made up of an alloy (Ag—Cu alloy) of silver and copper was used for the sealing members 231 and 232. The outer diameter of the arc tube 21 was 10 mm, and the voltage impressed to the external electrodes 31 and 32 was 3 kV when the lamp 1 was lit.

An excimer lamp 1 according to the second embodiment shown in FIGS. 3, 4A and 4B was prepared. Three kinds of excimer lamps A, B and C as the excimer lamp 1 were prepared. In the inner space 24 of the electric discharge container 2 of the lamp A, 100 Torr of argon (Ar) and sulfur hexafluoride ($SF_6$) was filled. In the inner space 24 of the electric discharge container 2 of the lamp B, 100 Torr of argon (Ar) and carbon tetrafluoride ($CF_4$) was filled. In the inner space 24 of the electric discharge container 2 of the lamp C, 100 Torr of argon (Ar) and nitrogen trifluoride ($NF_3$) was filled. In the Lamp A, the amount (99.9%) of the argon (Ar) and that (0.1%) of the sulfur hexafluoride ($SF_6$) was enclosed therein. In the Lamp B, the amount (99.9%) of the argon (Ar) and that (0.1%) of the carbon tetrafluoride ($CF_4$) was enclosed therein. In the Lamp C, the amount (99.9%) of the argon (Ar) and that (0.1%) of the nitrogen trifluoride ($NF_3$) was enclosed therein. Wax material which was made up of an alloy (Ag—Cu alloy) of silver and copper was used for the sealing members 231 and 232 of the lamps A, B, and C, respectively. The insulator 6 was formed by applying, for example, paste in which silica particles are dispersed in organic solvent, so as to cover the outside portions of the external electrodes 31 and 32, and sintering the applied paste. The outer diameter of the arc tube 21 was 10 mm, and the voltage impressed to the external electrodes 31 and 32 was 7 kV when the lamp 1 was lit.

Moreover, the excimer lamp 1 according to the third embodiment shown in FIGS. 6, 7A and 7B was prepared as an example. Three kinds of excimer lamps D, E and F as the excimer lamp 1 were prepared. In the inner space 24 of the electric discharge container 2 of the lamp D, 100 Torr of argon (Ar) and sulfur hexafluoride ($SF_6$) was filled. In the inner space 24 of the electric discharge container 2 of the lamp E, 100 Torr of argon (Ar) and carbon tetrafluoride ($CF_4$) was filled. In the inner space 24 of the electric discharge container 2 of the lamp F, 100 Torr of argon (Ar) and nitrogen trifluoride ($NF_3$) was filled. In the Lamp D, the amount (99.9%) of the argon (Ar) and that (0.1%) of the sulfur hexafluoride ($SF_6$) was enclosed therein. In the Lamp E, the amount (99.9%) of the argon (Ar) and that (0.1%) of the carbon tetrafluoride ($CF_4$) was enclosed therein. In the Lamp C, the amount (99.9%) of the argon (Ar) and that (0.1%) of the nitrogen trifluoride ($NF_3$) was enclosed therein. Wax material which was made up of an alloy (Ag—Cu alloy) of silver and copper was used for the sealing members 231 and 232 of the lamps D, E, and F, respectively. The outer diameter of the arc tube 21 was 10 mm, and the voltage impressed to the external electrodes 31 and 32 was 8 kV when the lamp 1 was lit. The depth of the grooves 7 of the respective lamps D, E, and F was 0.3 mm and the width of the grooves in the circumferential direction of the arc tube 21 was 0.3 mm. The grooves 7 whose number was twelve were formed on the outer circumferential surface of the arc tube 21. In the lamps A, B, and C according to the third embodiment, a creeping distance between the electrodes 31 and 32 was from 7 mm to 10.6 mm.

When voltage was impressed to each lamp 1, the illuminance of each lamp 1 was measured, and further a period (life span) in which the illuminance could be maintained was measured. FIG. 10 shows a table the experimental result. The optical intensity shown in FIG. 10 represents the relative value when the illuminance of Comparative Example 1 is set to a reference value.

In Comparative Example 2, when applied voltage was 5 kV, the optical intensity was 0.7. However, creeping discharge occurred so that voltage of 5 kV or more could not be impressed. It is considered that since sulfur hexafluoride ($SF_6$) with high chemical stability were hard to be ionized, electric discharge did not occur in the inner space 24 of the discharge tube 2, so that the electric discharge (creeping discharge) occurred on the side face.

In the lamps A, B, and C according to the second embodiment, the optical intensity was 1.1 when the applied voltage was 7 kV, so that the illuminance which was higher than that of the lamp 1 of the prior art was obtained. Furthermore, the life span hours was one thousand hours (1,000) or more, during which creeping discharge was not generated. This is considered that it was possible to prevent the creeping discharge by the formation of the insulator 6 on the external electrodes 31 and 32. In connection with this, the voltage impressed to the external electrodes could also be raised to 7 kV, so that the higher illuminance than that of the prior art could be obtained. Moreover, in the excimer lamp 1 according to the second embodiment, compared with the excimer lamp 1 of the prior art, absorption of the fluorine ions in the sealing members 231 and 232 could be suppressed by using a fluoride with high chemical stability as the light emitting gas, so that the illuminance could be maintained for a long time.

In the lamps A, B, and C according to the third embodiment, the optical intensity was 1.2 when the applied voltage was 8 kV, so that the illuminance which was higher than that of the lamp 1 of the prior art was obtained. Furthermore, the life span hours was one thousand (1,000) or more, during which creeping discharge was not generated. This is considered that it was possible to prevent the creeping discharge by the formation of the grooves 7 on the external electrodes 31 and 32. In connection with this, the voltage impressed to the external electrodes could also be raised to 8 kV, so that the higher illuminance than that of the prior art could be obtained. Moreover, in the excimer lamp 1 according to the third embodiment, compared with the excimer lamp 1 of the prior art, absorption of the fluorine ions in the sealing members 231 and 232 could be suppressed by using a fluoride with high chemical stability as the light emitting gas, so that the illuminance could be maintained for a long time.

Therefore, since in the excimer lamp 1 according the second and third embodiments, in the circumferential direction of the arc tube 21, the insulator 6 was formed so as to cover the external electrodes 31 and 32 or the grooves 7 were formed between the external electrodes 31, and 32, it was possible to prevent creeping discharge so that voltage applied thereto could be raised. Therefore, in the excimer lamp according to the second and third embodiments, as compared with the excimer lamp 1 of the prior art, it was possible to achieve longer life span and and to obtain higher illuminance.

The preceding description has been presented only to illustrate and describe exemplary embodiments of the present excimer lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An excimer lamp comprising:

an electric discharge container in which a sealing member is provided between a lid member and an arc tube which does not contain silica, and a pair of external electrodes which are separately provided on an outer surface of the arc tube, wherein rare gas and a fluoride is enclosed in the electric discharge container, and the fluoride is sulfur hexafluoride, carbon tetrafluoride, or nitrogen trifluoride.

2. The excimer lamp according to claim 1, further including an insulator or grooves which are formed between the external electrodes which face each other on an outer surface of the arc tube.

3. The excimer lamp according to claim 1, wherein the external electrodes are covered with an insulator.

* * * * *